US010981029B2

(12) United States Patent
Parise

(10) Patent No.: US 10,981,029 B2
(45) Date of Patent: Apr. 20, 2021

(54) EXERCISE TUBING FOR HIGH INTENSITY INTERVAL TRAINING AND METHODS OF USE

(71) Applicant: FMFC LLC, East Haven, CT (US)

(72) Inventor: David Parise, East Haven, CT (US)

(73) Assignee: FMFC LLC, East Haven, CT (US)

( * ) Notice: Subject to any disclaimer, the term of this patent is extended or adjusted under 35 U.S.C. 154(b) by 23 days.

(21) Appl. No.: 16/566,259

(22) Filed: Sep. 10, 2019

(65) Prior Publication Data

US 2020/0078628 A1 Mar. 12, 2020

Related U.S. Application Data

(60) Provisional application No. 62/783,822, filed on Dec. 21, 2018, provisional application No. 62/729,209, filed on Sep. 10, 2018.

(51) Int. Cl.
*A63B 21/02* (2006.01)
*A63B 21/055* (2006.01)
(Continued)

(52) U.S. Cl.
CPC ..... *A63B 21/028* (2013.01); *A63B 21/0442* (2013.01); *A63B 21/0555* (2013.01);
(Continued)

(58) Field of Classification Search
CPC .. A63B 7/00; A63B 7/04; A63B 7/045; A63B 21/0004; A63B 21/00043;
(Continued)

(56) References Cited

U.S. PATENT DOCUMENTS 4,505,474 A * 3/1985 Mattox ..... A63B 5/20 482/82
5,044,250 A * 9/1991 Beyer ..... G10D 13/12 84/422.4

(Continued)

OTHER PUBLICATIONS

Son of the Beast. Datasheet [online]. Hark'n Technologies, Inc., 2017 [retrieved on Dec. 3, 2019]. Retrieved from the Internet: <URL:https://stroops.com/product/son-of-the-beast/>.

(Continued)

*Primary Examiner* — Gary D Urbiel Goldner
(74) *Attorney, Agent, or Firm* — DeLio Peterson & Curcio LLC; David R. Pegnataro

(57) ABSTRACT

An exercise apparatus for high intensity interval training includes a pair of elastomer tubing devices being stretchable beyond a resting length and further having a first end forming a hand grip for a user, and an opposing end including an anchor portion to enable releasable attachment to a fixed mount. The elastomer tubing devices are independently affixable to one or more fixed mounts at a first distance between the respective anchor portions along a transverse plane and a second distance above ground level to permit independent or tandem oscillation by the user, wherein the elastomer tubing devices are stretched a predetermined distance beyond the resting length and maintained approximately at the predetermined distance during the oscillation. Mechanical impedance of the elastomer tubing devices is adjustable by the user working against inertia generated during the oscillation.

19 Claims, 18 Drawing Sheets

(51) Int. Cl.
*A63B 21/04* (2006.01)
*A63B 21/00* (2006.01)

(52) U.S. Cl.
CPC ..... *A63B 21/0557* (2013.01); *A63B 21/4035* (2015.10); *A63B 2208/0204* (2013.01); *A63B 2208/0223* (2013.01); *A63B 2208/0228* (2013.01); *A63B 2208/0252* (2013.01); *A63B 2208/0257* (2013.01)

(58) Field of Classification Search
CPC ..... A63B 21/02; A63B 21/026; A63B 21/027; A63B 21/028; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0057; A63B 21/08; A63B 21/16; A63B 21/1681; A63B 21/169; A63B 21/4023; A63B 21/4027; A63B 21/4033; A63B 21/4035; A63B 21/4043; A63B 71/028; A63B 2071/0063; A63B 2071/0072; A63B 2071/024; A63B 2071/025; A63B 2071/026; A63B 2208/0204; A63B 2208/0223; A63B 2208/0228; A63B 2208/0238; A63B 2208/0242; A63B 2208/0252; A63B 2208/0257; A63B 2209/00; A63B 2210/00; A63B 2210/50
See application file for complete search history.

(56) References Cited

U.S. PATENT DOCUMENTS 5,152,523 A * 10/1992 Keen ..... A63B 21/0602 482/93
8,038,585 B1 * 10/2011 Brown, Jr. ..... A63B 21/0004 482/110
8,827,231 B1 * 9/2014 Blair ..... A63B 21/4023 248/507
9,265,984 B2 * 2/2016 Huber ..... A63B 23/03541
9,901,766 B2 * 2/2018 Ross ..... A63B 21/055
10,220,242 B2 * 3/2019 Matos ..... A63B 21/4015
2014/0141943 A1 * 5/2014 DiPace ..... A63B 21/0557 482/93
2014/0141946 A1 * 5/2014 Huber ..... A63B 21/0609 482/110
2014/0274612 A1 * 9/2014 Pesko ..... A63B 21/0609 482/139
2015/0265869 A1 * 9/2015 Hemstreet ..... A63B 23/12 482/110
2015/0283421 A1 * 10/2015 Gaylord ..... A63B 21/0609 482/110
2017/0203145 A1 * 7/2017 Proudian ..... A63B 21/0609
2017/0368405 A1 * 12/2017 Matos ..... A63B 23/1218

OTHER PUBLICATIONS

Gorilla Bow 50 lb Gorilla Band. Datasheet [online]. Gorilla Fitness, LLC, 2019 [retrieved on Dec. 3, 2019]. Retrieved from the Internet: <URL:https://www.gorillabow.com/collections/accessories/products/50-lb-gorilla-band/>.
Cobra & Mini Cobra Comparison. Datasheet [online]. Gun-Ex USA, Inc., 2019 [retrieved on Dec. 3, 2019]. Retrieved from the Internet: <URL:https://app.box.com/s/x5xs2obe5fqp11o8hs2whuhr2q5x5oe8/>.
Efitment A011 Elastic Battle Rope. Datasheet [online]. Zoovaa, Inc., 2019 [retrieved on Dec. 3, 2019]. Retrieved from the Internet: <URL:https://efitment.com/product/efitment-a011-elastic-battle-rope-fitness-training/>.

* cited by examiner

EXERCISE TUBING FOR HIGH INTENSITY INTERVAL TRAINING AND METHODS OF USE

BACKGROUND OF THE INVENTION

1. Field of the Invention

The present invention relates generally to exercise equipment, and more particularly, to an improved exercise apparatus for interval training, comprising at least one elastomer tube adapted to be anchored opposite the user at a fixed point and having a coil and recoil feedback mechanism to indicate to the user when the force in the tube is altered by oscillation of the tube by the end user. During oscillation, the transverse abdominal muscles and entire musculoskeletal system are engaging and trying to dissipate the forces coming into the body through the oscillating tube.

2. Description of Related Art

Performing short bouts (approximately 1 to 3 minutes) of High Intensity Interval Training ("HIIT"), Tabata, or metabolic conditioning (hereinafter collectively referred to as "HIIT"), are known exercise methods that improves muscle control, flexibility, coordination, strength, and muscular obesity through physical and neurological/mental conditioning. Generally, HIIT involves alternating between high and low intensity exercises, or between periods of high intensity exercise followed by short periods of rest. The typical HIIT program requires an extreme demand of oxygen by the user.

Examples of typical exercises included in a HIIT exercise routine include burpees, kettlebell swings or snatches, or jumping squats, or combination exercises such as alternating pull-ups and push-ups, alternating dumbbell snatches followed by a wrestler's sprawl, or alternating short sprints followed by short sets of push-ups, for example. Each of these exercises involve high intensity training of the upper and lower extremities, where the body's anaerobic metabolism predominates. In general, the body can't get oxygen to where it needs to go fast enough. This is very inefficient, but it lets the body produce short bursts of speed or high energy.

Another such conventional HIIT training method for the upper extremities is known as the "battling ropes," wherein a single rope may be secured at its midpoint to an anchor point on the ground opposite the user, or alternatively, a pair of ropes are secured at either a common anchor point or at adjacent anchor points on the ground, and the ends of the rope(s) are held by an end user during a variety of upper body exercise movements performed over a short period of a HIIT. The oscillation of the ropes during the exercises is entirely generated and maintained by the user, and intended to engage a user's arms, shoulders, and core muscles to improve coordination, flexibility and muscle strength.

Conventional means of HIIT have several disadvantages. Typical HIIT programs endanger oxygen supply to tissues, increase body temperature, reduce body fluids and fuel storage, and can cause tissue damage. Intense exercise creates endocrine and defense reactions that are similar to those elicited by low blood oxygen, high blood carbon dioxide, acidosis, high body temperature, dehydration, low blood sugar, physical injury and psychological stresses. Hormonally, a user's body can also swing vastly between extremes. Moreover, substantial stress is put on one's joints during the periods of high intensity pressing/pulling/twisting/jumping movement and muscle engagement.

A need exists for an improved exercise device and method of performing HIIT exercises that has superior impact on muscle control and development, as opposed to more conventional means of HIIT. A further need exists for a means to achieve the aerobic and anaerobic benefits of HIIT without added stress to one's joints.

SUMMARY OF THE INVENTION

Bearing in mind the problems and deficiencies of the prior art, it is therefore an object of the present invention to provide an improved exercise device which assists a user in performing abdominal/core/full body wave-patterned, oscillated strength exercises during HIIT.

It is another object of the present invention to provide an exercise device comprising a pair of elastomer tubes capable of being anchored at adjacent points approximately body width apart and at a distance above the ground, the elastomer tubes having a coil and recoil feedback mechanism to indicate to the user when the vibration/force in the tube is altered by oscillation by the end user in performing abdominal, core, and/or full body wave-patterned, oscillated strength exercises.

It is still another object of the present invention to provide an improved HIIT exercise method utilizing a pair of elastomer tubes capable of being anchored at adjacent points approximately body width apart and having a coil and recoil feedback mechanism to indicate to the user when the vibration/force in the tube is altered by oscillation by the end user in performing abdominal, core, and/or full body wave-patterned, oscillated strength exercises.

Still other objects and advantages of the invention will in part be obvious and will in part be apparent from the specification.

The above and other objects, which will be apparent to those skilled in the art, are achieved in the present invention which is directed to an exercise apparatus comprising a pair of elastomer tubing devices, each elastomer tubing device having a resting length, a resting inner diameter, a resting outer diameter, and a tube thickness. Each elastomer tubing device is stretchable beyond the resting length and further has a first end comprising a segment having a second outer diameter that is greater than said resting outer diameter and forming a hand grip for a user, and an opposing end including an anchor portion to enable said opposing end to be releasably attached to a fixed mount. At least one of the elastomer tubing devices, and preferably both, comprises a Q Factor of about 5. The pair of elastomer tubing devices are independently affixable to one or more fixed mounts at a first distance between the anchored opposing ends of each tubing device and a second distance above ground level to permit independent or tandem oscillation of said elastomer tubing devices by the user, where the elastomer tubing devices are stretched a predetermined distance beyond the resting length and maintained at said predetermined distance during said oscillation. The mechanical impedance of the elastomer tubing devices is adjustable by the user working against inertia generated during said oscillation.

The first distance may be between about 24 inches to about 36 inches, and the second distance may be between about 36 inches and about 45 inches. At least one of the elastomer tubing devices may have a resting length of about 9 ft 5 inches, a resting inner diameter of about ½ inch, a resting outer diameter of about inch, and a tube thickness of about ⅛ inch. At least one of the elastomer tubing devices may comprise one or more of a tensile strength of about 3500 psi, an elongation of about 750%, a hardness of about 35+/−5 Shore A, a 100% Modulus of 125 psi, and a specific gravity of 0.97.

In an embodiment, the tube anchor portion may comprise a loop end and a metal ring, where the loop end is folded onto itself and inserted into an opening in the tube end to secure the metal ring and where the loop end is held in the opening of the tube end by compression. Each elastomer tubing device may include a grip plug disposed within the first end segment for forming a hand grip for a user.

In another aspect, the present invention is directed to an exercise apparatus comprising a pair of elastomer tubing devices as described above, where at least one of the elastomer tubing devices, and preferably both, comprises a center-loaded portion within the inner diameter disposed between the opposing tube ends and having a mass. The center-loaded portion may comprise between about 2% to about 7% of the resting length of the elastomer tubing device. The center-loaded portion may be bookended by plugs within the inner diameter of the tube on either side of the center-loaded portion to concentrate the mass over a defined area.

In yet another aspect, the present invention is directed to a method of performing an exercise program, the method comprising: providing a pair of elastomer tubing devices, each elastomer tubing device having a resting length, a resting inner diameter, a resting outer diameter, and a tube thickness. Each elastomer tubing device is stretchable beyond the resting length and further has a first end comprising a segment having a second outer diameter that is greater than said resting outer diameter and forming a hand grip for a user, and an opposing end including an anchor portion to enable said opposing end to be releasably attached to a fixed mount. At least one of the elastomer tubing devices, and preferably both, comprises a Q Factor of about 5. The method comprises independently affixing the pair of elastomer tubing devices to one or more fixed mounts at a first distance between the anchored tube ends and a second distance above ground level and stretching the elastomer tubing devices to a predetermined distance beyond the resting length. While maintaining the elastomer tubing devices a predetermined distance beyond the resting length, the method further comprises oscillating said elastomer tubing devices by the user, and adjusting the mechanical impedance of the elastomer tubing devices by the user working against inertia generated during said oscillation.

The exercise program may comprise one or more routines selected from the group comprising routines performed with the user in a standing position, routines performed with the user in a squatting or partially-squatting position, routines performed with the user in a turned or partially-turned squatting position, routines performed with the user in a prone position, routines performed with the user in a supine position, and routines performed with the user in a seated or partially-seated position.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

Figure 1:
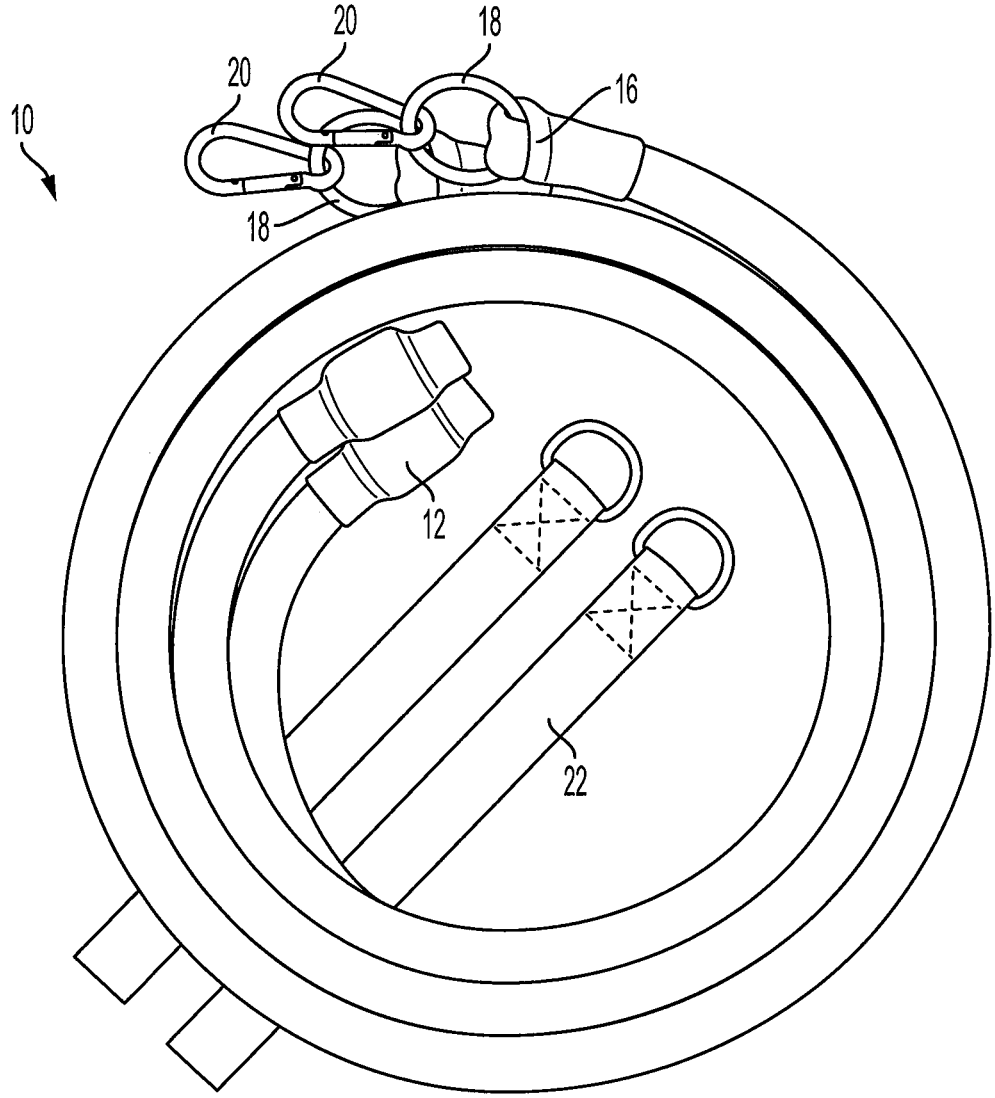
FIG. 1 is a top plan view of one embodiment of the exercise apparatus of the present invention.
Figure 2:
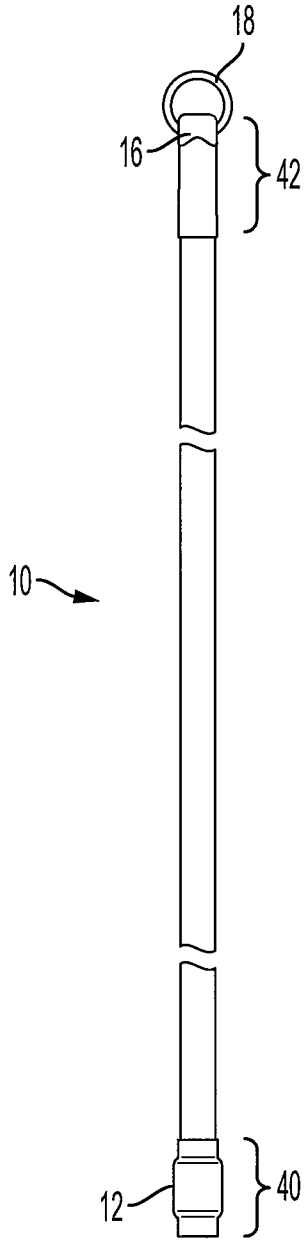
FIG. 2 is a plan view of one of the elastomer tubing devices shown in FIG. 1.

In describing the embodiments of the present invention, reference will be made herein to FIGS. 1-20 of the drawings in which like numerals refer to like features of the invention.

Certain terminology is used herein for convenience only and is not to be taken as a limitation of the invention. For example, words such as "upper," "lower," "left," "right," "horizontal," "vertical," "upward," "downward," "clockwise," or "counterclockwise" merely describe the configuration shown in the drawings. Indeed, the referenced components may be oriented in any direction and the terminology, therefore, should be understood as encompassing such variations unless specified otherwise. For purposes of clarity, the same reference numbers will be used in the drawings to identify similar elements.

Additionally, in the subject description, the word "exemplary" is used to mean serving as an example, instance or illustration. Any aspect or design described herein as "exemplary" is not necessarily intended to be construed as preferred or advantageous over other aspects or design. Rather, the use of the word "exemplary" is merely intended to present concepts in a concrete fashion.

The present invention is directed in an exemplary aspect to an improved exercise device for HIIT, comprising at least one elastomer tube having a grip at one end and anchored at the opposite end to a stationary anchor point above the ground. When the tube(s) are anchored, one end creates a stable base for the tube(s) from which to emanate wave oscillations created by the user on the other end of the tube. The resistance of the workout is generated by the user; i.e., the user is working against the inertia of the oscillating waves that they are creating. In a classic mechanical impedance model, this energy is called "reactance."

In use, the tubes are held firmly in each hand, with the hands held directly along the user's sides, transverse to the stomach and under the rib cage. The elbows are between 85-90 degrees of flexion. The tubes are anchored to an external stable base opposite the user. This external stable base may include, but is not limited to, wall mounts, rails, fences, gates, poles, and the like. In one embodiment, the user may use a strap connected to a metal ring at one end of each tube to secure the tubes to an exercise machine consisting of two anchor points between two-to-four feet apart horizontally, and between two-to-four feet high vertically.

While maintaining a posture in which the cervical spine is in a substantially neutral position, the muscles of the abdomen are drawn in as if the user is taking their belly button away from the waistline of their pants. The user will try to maintain and hold this draw-in position for the first intensity bout for one (1) to three (3) minutes. The entire musculoskeletal system, core, and abdominals are being engaged or activated and the user can start to oscillate the flow of the tubes in a continuous wave motion. If the exercise is being performed properly, the tubes will bounce up and down from the center of gravity (mid tube) in a flowing, wave-like pattern while the muscles of the transverse abdominis (TVA) are drawn in, the arms are by the user's side, the elbows flexed, the lower body flexed, and the legs are engaged. The internal pressure increases in the endoskeleton system. The intensity of the wave-like oscillated, flowing tube will increase heart rate, and the user breathes more oxygen liters than they normally would at rest.

In accordance with various embodiments, other attachment means may be used to attach the tubes to an external foundation point. The user may view the tubes during the exercise without the user's head turning while maintaining proper physiological positioning. Furthermore, other feedback means may be used, such as sounds generated from the tubes oscillating in space (wind, tornado, hurricane sounds) that indicate to the user the oscillation pressure which occurs during proper use of the present invention.

Referring now to FIGS. 1-8, an exemplary embodiment of the exercise apparatus of the present invention is shown. As shown in FIG. 1, the device may comprise a pair of elastomer tubes 10, each approximately 9 ft. 5 in. in length L at rest, with a ½" resting inner diameter ID×⅛" tube thickness t×¾" resting outer diameter OD (12.7 mm×3.17 mm×19.05 mm). Unless specifically defined otherwise, as used herein, the words "about," "at least," "approximately," "substantially," or the like, are intended to encompass the stated quantifier or dimension plus or minus ten percent. In other embodiments, the tubing may be incrementally greater than or less than 9 ft. 5 in. in length L at rest, and embodiments of about 8 ft. to about 10 ft. have also been shown to be effective. The tubes may be made from hypoallergenic rubber, elastomer, or latex, which will substantially conform to and maintain its spring-like motion. The tubes may be a combination of such materials such that it is preferably portable and elastic in nature, making it easy to oscillate by the user in many spring-like wave motions and patterns.

In an embodiment, the tubes may be comprised of natural latex having 50 micrograms or less of water-extractable protein per gram, and are formulated using a continuous dip process. The tubes preferably have a tensile strength of at least 3500 psi, an elongation of at least 750%, a hardness of 35+/−5 Shore A, a 100% Modulus of 125 psi, and a specific gravity of 0.97. The physical properties of the elastomer tubing of the present invention exceed those of conventional fitness tubing known in the art.

Figure 3:
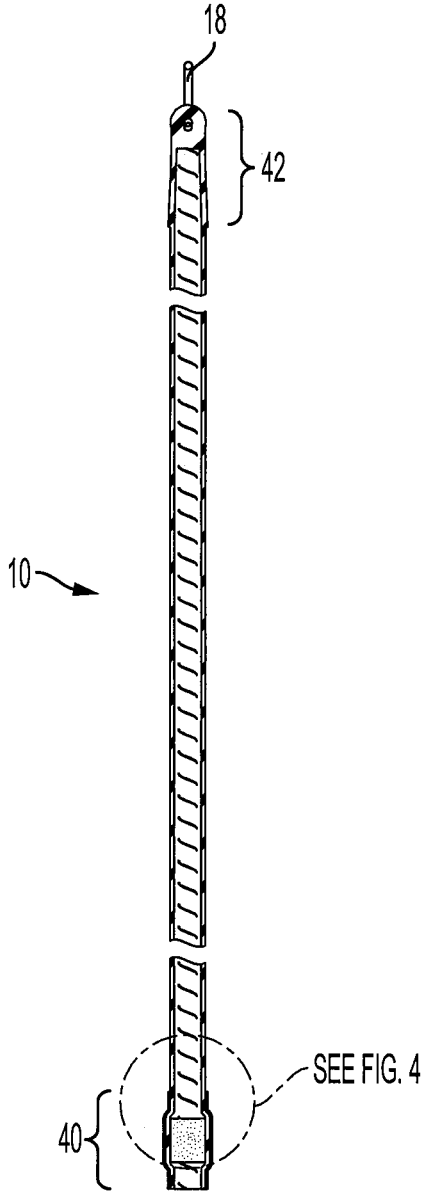
FIG. 3 is a cross-sectional view of the elastomer tubing device of FIG. 2.
Figure 4:
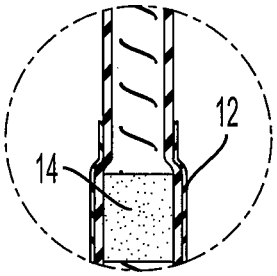
FIG. 4 is an isolated, cross-sectional view of the grip end of the elastomer tubing device of FIGS. 2 and 3.
Figure 5:
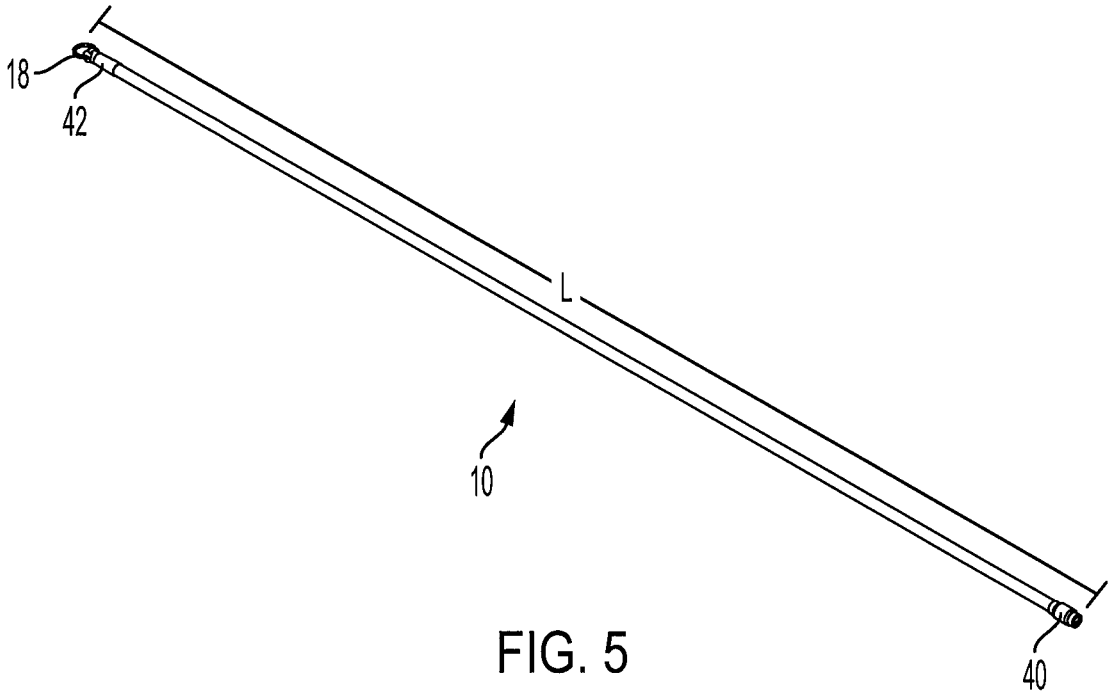
FIG. 5 is a perspective view of the elastomer tubing device of FIG. 2.
Figure 6:
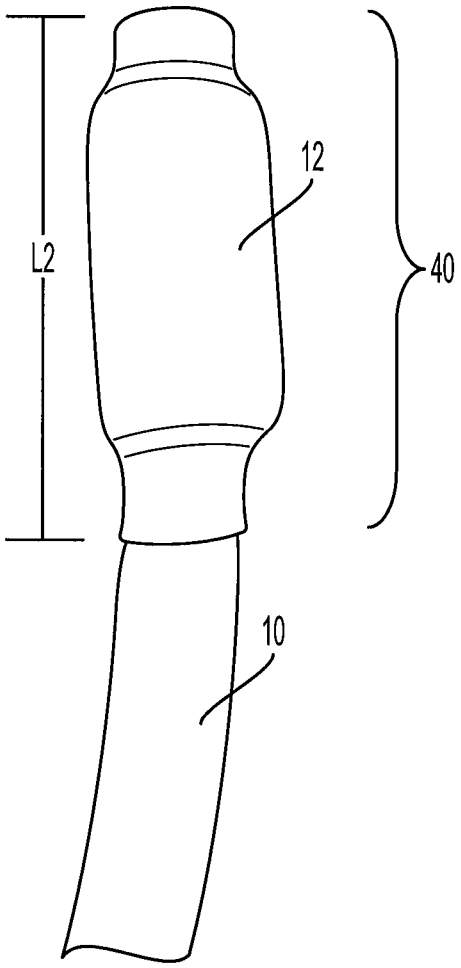
FIG. 6 is an isolated, side plan view of the grip end of the elastomer tubing device of FIG. 2.
Figure 7:
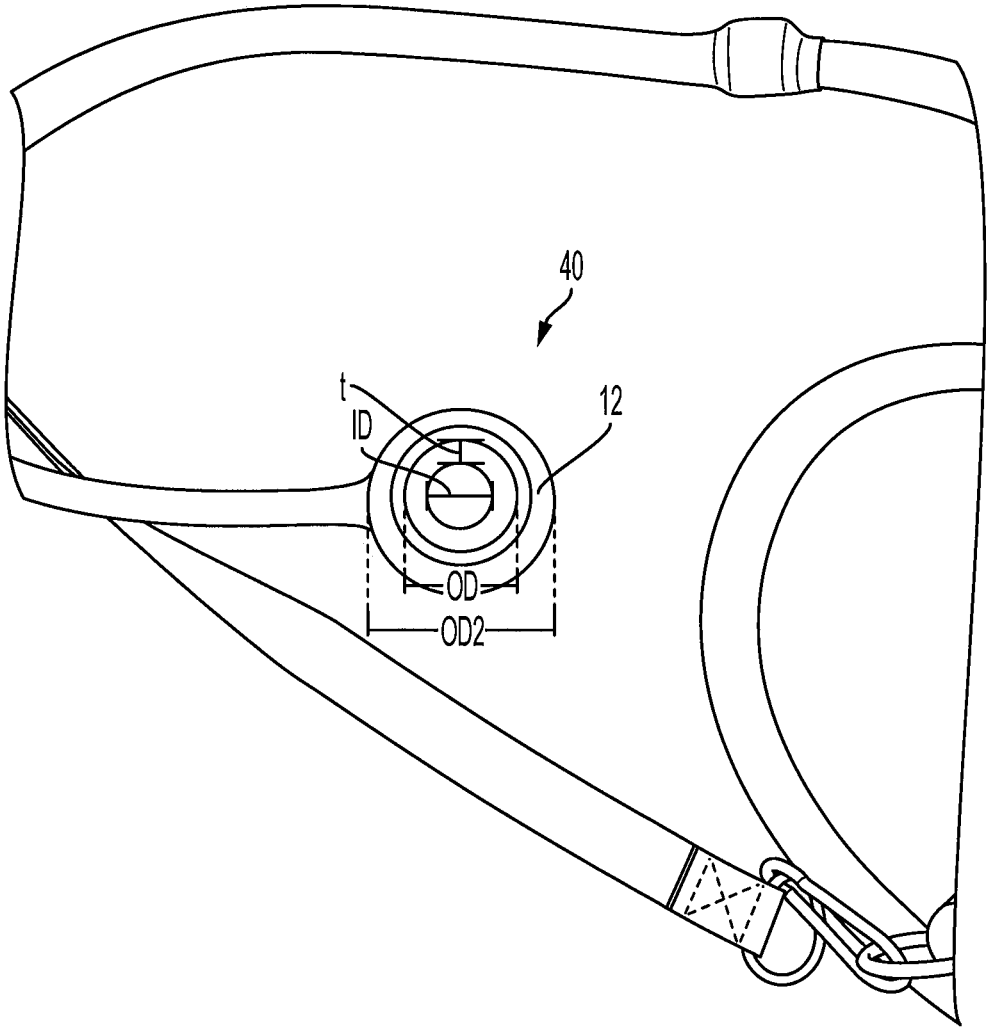
FIG. 7 is a top end view of the grip end of the elastomer tubing device of FIG. 2.

In at least one embodiment, a rubber or plastic end cap 12 encases a first end 40 of the tube and serves as a grip for an end user's hand during oscillation of the tubes, as will be described below. The end cap or grip 12 may be approximately 2.5" to 4" in length L2 (FIG. 6). In one or more embodiments, the end cap may include a rubber or plastic grip plug 14 inserted and positioned within the non-anchored end 40 of the tube, such that the end 40 of the tube is stretched beyond its resting outer diameter OD of ¾" to a greater outer diameter OD2 for a predetermined distance in the direction of the midpoint of the tube 10 to form a hand grip. As shown in FIGS. 3 and 4, and more particularly seen in FIG. 7, plug 14 is inserted into the end 40 of the elastomer tube to stretch the tube beyond its resting outer diameter OD to a greater outer diameter OD2, and is held in place by compression of the tubing.

Figure 8:
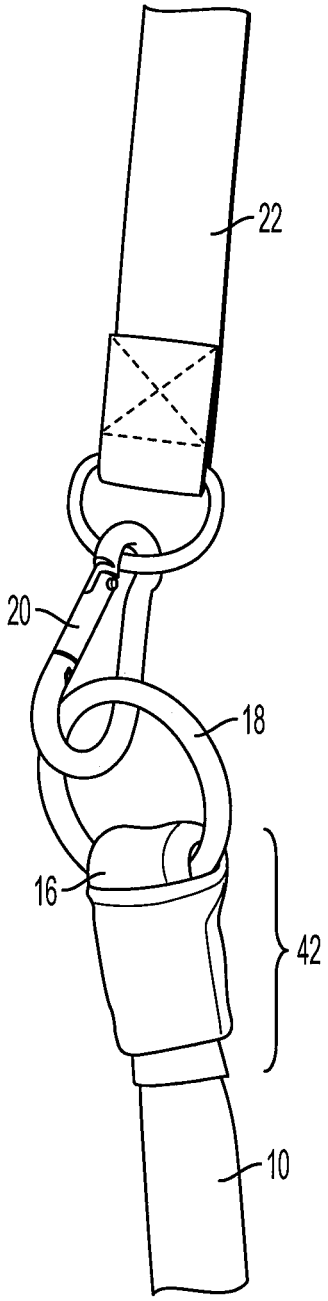
FIG. 8 is an isolated, side plan view of the anchor end of the elastomer tubing device of FIG. 2.
Figure 9:
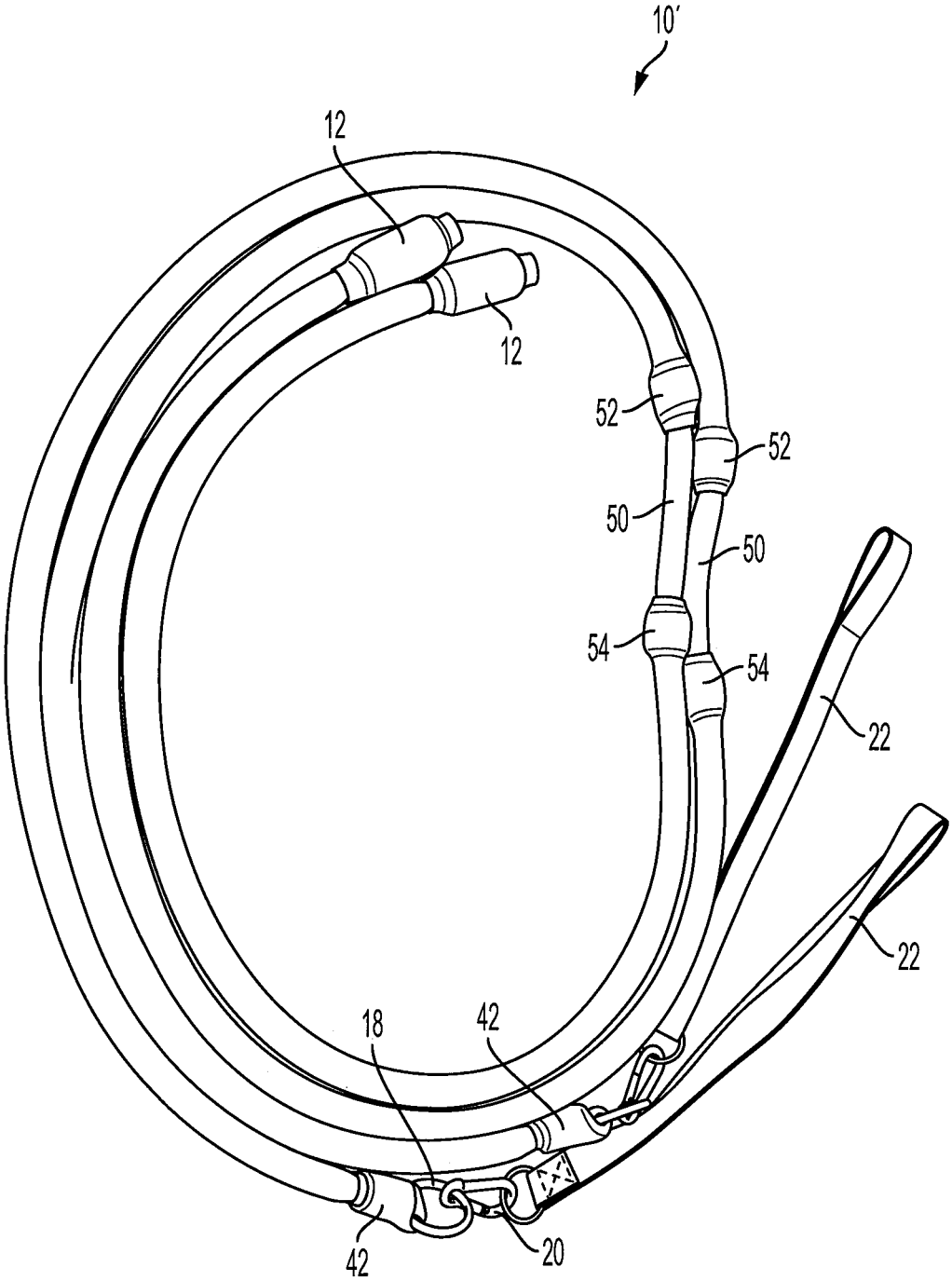
FIG. 9 is a top plan view of another embodiment of the exercise apparatus of the present invention, wherein the inner portion of each elastomer tubing device includes a weighted section at an approximate midpoint of the resting length of the tube.

As best seen in FIG. 8, on the opposite end 42 of the tube may be an anchor portion comprising a fixed metal ring 18, such as an O-ring or D-ring, for releasably anchoring the tube to a fixed mount 30. The anchor portion may comprise a loop end 16 for securing the metal ring 18, and the loop end 16 may be folded over itself and inserted back into the end 42 of the tube and may be held in place by compression. A fastener or carabiner 20 may also be included for connecting the metal ring 18 to the fixed mount 30. In one or more embodiments, each end 40, 42 of the tube may further include an external heat-shrinkable protective wrap. At the anchoring or ringed end 42 of the tube, the heat-shrinkable wrap provides for added stress tension at the point where the metal ring 18 is anchored, and at the opposite end cap the wrap provides a non-slip, safer grip, particularly in embodiments utilizing a rubber or plastic insert or plug 14 within the tube inner diameter ID. In one or more embodiments, the user may use a nylon or nylon-type strap 22, wall mount anchor, hook, loop rail fasteners, buckle, velcro straps, or the like, connected to the metal ring 18 to anchor the tube end 42 to a fixed mount 30, as shown in FIG. 8.

The elastomer tubes 10 may be mounted on a wall, door jam, fence, pole, tree, gate, and/or bracket, defining a solid stable anchoring base of support. As shown in FIGS. 14-20, for example, the tubes may be anchored approximately 36 to 45 inches off of the ground at equal heights H, and between approximately 24 to 36 inches apart in width W on a transverse plane. In a preferred embodiment, the tubes 10 should be anchored approximately at a user's waist height and slightly further than shoulder width apart for maximum aerobic and anaerobic benefit. One advantage of the present invention is that the anchoring allows the system to be used in an unlimited variety of locations.

In use, the tubes 10 are snugly held in each hand with the end cap grip 12, 14 positioned in the palm of a user's hands and the tubes are pulled away from the anchor point 30 to elongate the tubes several inches beyond their resting length L to a length L+n, where n is defined in inches. The user's arms are against the sides of the body/abdominal wall muscles, in distinction along the sides with 85-95 degrees of elbow flexion. The tubes 10 are then oscillated independently or in tandem by the user to move, bounce, and spring in one or more of a wave-like pattern, rotational pattern, drumroll pattern, slap pattern, or lateral oscillation pattern. The tubes 10 place opposing forces against the exomuscular and endomuscular system. The tubes 10 while in motion add applied force, and challenge every muscle in the body to stabilize, as the arms begin and continue to mobilize. The free motion oscillation waves created by the user's upper extremities put less stress on the joints as compared to conventional HIIT exercises which involve bursts of jumping or pressing, while maintaining the high intensity cardiovascular component. With relatively small body movements, a user can quickly establish an oscillation, and once in motion, the elasticity and resistance of the elastomer tubing properties helps the user maintain an oscillating wave pattern. The independent or tandem oscillation of each tube 10, in connection with the user working against the inertia of the oscillating waves created, further assists in the development of symmetrical strength and coordination.

The user maintains a strong and stable posture in which the cervical spine is in a substantially neutral position. The user holds their arms by their sides with elbows flexed, and the abdomen is drawn in and held for a period of time, e.g., one (1) to three (3) minutes, and then released when the exercise is finished. The exercise may be repeated four times, in three (3) minute patterns, for maximum benefit. The patterns will vary based on the user's then-current physical capabilities and physical conditioning. A total of four rounds or circuits spanning 1-3 minutes in length per circuit equates to a 12 minute workout, which should be performed four times per week for optimal results.

If the exercise is being performed properly, the oscillating motion (vibrational patterns) of the tubes 10 sends or injects a pressure force of opposing resistance, while the muscles of the user's abdomen and all core and superficial muscles are drawn in and engaged. In order to provide useful feedback that the muscles of the abdomen region (core) along with superficial muscles (outer muscles) are properly being activated, the user can follow the present invention's recommended exercise methodologies, as will be described below. Sounds generated from the tubes oscillating in space (wind, tornado, hurricane sounds) will indicate to the user the oscillation pressure which occurs during proper use of the present invention. The vertical, tornado, and horizontal waves of the tubes can be performed while attached with an anchor system provided. The exercise device of the present invention may also roll into a more compact configuration for storage or travel.

In another embodiment, an articulable rail strap 22 may be used between the tubes and the user. The tubes 10 may be coupled to a door connector which anchors the tube to a solid base. In another example, the tubes 10 may be attached to a squat rig or squat rack which places the tubes further at a distance from the body and at a relatively vertically higher location to facilitate visual inspection. In addition, the tubes 10 may be attached to a PVC anchor system with a strap that the tubes are visible by the user when the arms are in an elbow flexed oscillating position against the body.

The physics behind the present invention approximate an elastic body being only slightly stretched for a matter of inches (unlike conventional fitness tubing and elastic resistance bands which are held eccentrically and concentrically through a full range of motion), and the elastomer tubing 10 of the present invention is adapted to withstand 600 or more pounds of torque pressure over prior art fitness tubing. An elastic body or material for which this equation can be assumed is said to be an extension of an individual's upper extremities, i.e., the tubes are extensions off of the user's core.

The force (F) of the user creating momentum (M) needed to oscillate a spring-like motion over the distance of the length of the tubes are proportional to said distance. That is, where there is a constant factor characteristic of the spring-like crest and trough along the wavelength.

The present invention is the real response of rubber-like high protein tubes creating resistance profiles that react with intersegmental core stabilizers. These core stabilizing mechanisms or reactions are a byproduct to external applied forces from the user. The forces entering the body must eventually fail once the forces exceed some exertion limit, since no determination on one's physical capabilities can be confirmed beyond a certain rate of exertion, or stretched beyond a maximum oxygen intake, without some permanent loss of control or change of state. This is a user-defined perceived rate of exertion, measured on the Borg Scale.

Many materials such as ropes and other elastomers will noticeably deviate from the specificity, functionality, or characteristics of the present invention. The precise length, outside diameter, and inside wall thickness of the tube of the present invention is directly proportional to its functionality.

It is also the fundamental principle behind the spring-like, oscillated momentum, and the balance capabilities of the user to determine the proper force (F) and momentum (M) to originate in and dissipate out of the kinetic chain.

It has been shown in practice that the up (crest) and down (trough) oscillating wave momentum created by the user using the elastomer tubing of the present invention, attached to an anchor point at one end between about 24 to about 36 inches apart, and between about 36 to about 45 inches off the ground, is ideally proportional, and determines the action, reaction, coil, recoil, spring-like momentum applied to it.

The present invention makes it possible to deduce the relation between strain and stress, function and non-function for other objects (i.e., battling ropes, strings, cords, common rubber-like tubes) trying to mimic the method of use. Intrinsic properties, oscillation, momentum, force vectors, and intrinsic response intersegmentally are diminished when other outside objects are used to re-create the methods of use presented here.

Tubes unlike those needed to properly use the present invention behave like simple resistance bands that are stretched fully to essentially an elastic to plastic property to create resistance in a muscular region. A rope of any diameter (such as those used in the conventional HIIT exercise of "battling ropes") has no ability to act as a spring-like, oscillating force based on heaviness, and deregulating the intrinsic values of core and intersegmental stiffening. Battling ropes are anaerobic (without oxygen) that engage the global musculature (muscles that expand over a said number of joints to create movement) when the ropes are lifted and forced with the upper body to a wave-like heavy motion. Although ropes may be used in a wave pattern, they have a stiffness directly proportional to their cross-section area and are inversely proportional to their lengths. Unlike the elastomer tubes 10 of the present invention, battling ropes dwindle, and thus reduce the continuous momentum/force created in the crest and trough of the tubes. By contrast, use of the elastomer tubes 10 of the present invention result in predominantly High Intensity open capillary beds receiving more liters of oxygen (aerobic) versus heavy battle ropes which close capillary beds, calling upon and engaging the outer superficial musculature. Battle ropes require constant effort to maintain a steady oscillation, whereas a user of the elastomer tubing of the present invention can instead focus on other important aspects of their workout, such as maintaining posture and body movements, increasing the velocity of the bands without allowing it to move in alternate planes of motion, and developing endurance.

During use of the elastomer bands 10 of the present invention, there is a constant—a steady motion that requires a steady force by the user. The user applies a motive force needed to keep the bands moving in order to balance frictional and opposing oscillating forces. Those reactive opposing forces enter the user's entire musculoskeletal system. In terms of a stored-energy impedance model, the elastomer tubing 10 of the present invention has a "Q Factor" (otherwise referred to as Quality Factor) of at least about 5. A "Q Factor" is a dimensionless parameter that describes how underdamped an oscillator or resonator is, and characterizes a resonator's bandwidth relative to its centre frequency. Higher "Q" indicates a lower rate of energy loss relative to the stored energy of the resonator, i.e., the oscillations die out more slowly. For comparison, Battle Ropes have a "Q" of far less than 1.

When used in motion, transverse waves travel from mid-crest to trough and the forces acting on a body are unbalanced (a resultant force acts). The body changes its velocity in the direction of the force at a rate proportional to the force and inversely proportional to its mass. The rate of change of velocity is acceleration of the tubes, and forces are transmuted or applied to the entire body.

If the motions mentioned above were in an upwardly accelerated lift, an outside observer would see the two tubes acting transversely with momentum, as oscillated waves from the crest to midline, to the trough and back to midline were spring-like and weightless in the user's hands. The resultant force would be sufficient to give the user the same upward acceleration from the tubes. The tubes on a small scale of force will try to take you to an accelerated position. The user must stabilize (stiffen) in that same athletic posture (i.e., a "Ready Position" in conventional exercise parlance) to help dissipate the momentum-like force waves that are rising and falling.

The present invention allows the hands to move in one or more of shaking patterns, circular movement patterns, zig-zag, or transverse momentum-like patterns, to create opposing force along the entire length of the tubes. The bands or tubes 10 must move at constant speed, dictated by the user, and it does require a force at right angles to its motion (gravitational attraction) to constantly change direction as an optional pattern. As a result, when using the elastomer tubing 10 of the present invention, the user tensionally engages the hands with oscillating movement in all directions, helping to increase hand strength.

The present invention interactions involve pairs of forces coming from and defined as the resting length L of the elastomer tubing 10, with an anchor point. During the action of the transverse wave (dictated with a predictable outcome by the user) mid-crest to midline, midline to trough, and back again, is a constant action and reaction.

The energy is stored as a result of applying a momentum-like oscillated, transverse force to deform the straight lined elastomer tube. The energy is stored until the user-controlled wave-like force is removed and the tubes spring back to their original transverse straight line shape. The deformation of the tubes in length to the anchor point could involve any one or more of waving, slapping, elliptical-like, internal rotation (also known as "double overs" in exercise parlance), circles, or zigzag movements. The deformation of the tube halts when the tubes are at rest. The tubes are designed specifically to store elastic potential energy, so long as they're in motion. That same energy is sent to the entire musculoskeletal system challenging stabilizers, neutralizers, and superficial musculature.

Although the elastomer bands 10 of the present invention can store elastic potential energy, the banding will typically have a high elastic limit. Unlike conventional rubber or elastic resistance tubing found in the fitness or medical industry, the elastomer tubes 10 of the present invention do not have to sustain load. The tubes are not eccentrically nor concentrically pulled and pushed to create regional emphasis in an anatomical region. The bands of the present invention require momentum induced by the user. The bands mimic a spring-like transverse wave with its greatest momentum force coming from the center (middle of the length of the tube) approximately 4.75 feet away from the user's grip.

In at least one embodiment, a string or cord, such as a 70 lb. test fishing line, may extend within and along the length of the tube 10 to provide additional safety features. For example, if either tube were to snap during inertial movement, the tube will ride along the length of the cord, preventing potential unwanted and dangerous recoil of the elastomer tube as a result of the potential energy created during movement of the tube being converted to kinetic energy.

The present invention's momentum wave is labeled as the "wave-spring constant." The spring force is a conservative force and conservative forces have potential energies associated with them, including the direction of the force being produced.

The work done by the end user is proportionate to the force-like opposition wave originating in and emanating out of the entire system (human body) the force of momentum is an ideal spring-like wave pattern.

For example: A trained archer has the ability to draw a longbow with a force. The momentum of that pull, force, coil, and recoil has a by-product of thrust to propel an object off the vertical string of said bow. The word vertical in this analogy is directly related to the user's hold position. The archer decided to hold the bow on a vertical plane relative to the world. For purposes of the present invention, motions and positions are relative to the body and not the world. The same spring-like action created by the archer is identical to the transverse spring-like wave pushing energy from midline (bow at rest) to the trough (bow pulled back) to the crest (bow as it forces arrow out and away) being initiated by the user of the tubes. Assuming the bow behaves like an ideal wave-like spring, this would allow the archer to make use of his full strength.

The elastomer tubing of the present invention can function as continuous waves, hence the term "wave-spring constant," but may often have hysteresis. This means the force versus wave-like crest trough extension curve follows a different path when the material is being deformed compared to when it is relaxing back to its equilibrium position.

The method of using the present invention employed for an ideal transverse, oscillated, wave-like spring will not work with conventional tubing purchased in the fitness industry.

An analysis to consider is how the ideal wave-like constant spring motion is one-dimensional. In reality, elastic materials or rubber tubing are three dimensional. The equivalent to the force (by user momentum) versus extension curve (crest-midline-trough) is the "stress vs. strain curve."

The work being initiated by the user of the present invention is the force of drag because air resistance is significant to the resistance created by the constant wave-like pattern. Hence, the elastic wave spring-like force being created by the user equates to deformed tubes attempting to recover their original shape. The air resistance adds to the difficulty and benefit of the resultant. When performed properly, the method of using the present invention results in sounds similar to the sounds created by a tornado, hurricane, whistling, swooshing, wind blowing through trees, howling, or any other array of swirling wind sounds.

The elastomer tubing 10 of the present invention will deform to some extent when subjected to a stress (a force per unit area). The user dictates the stress. The user can slow down the momentum-spring-like wave and reduce the force. The tubing of the present invention, because of its precise length, inner diameter ID, outer diameter OD, and tube wall thickness t, exerts an opposing force and this can lead to oscillation and wave-like spring patterns when the elastic material is attached to an anchor point.

Figure 10:
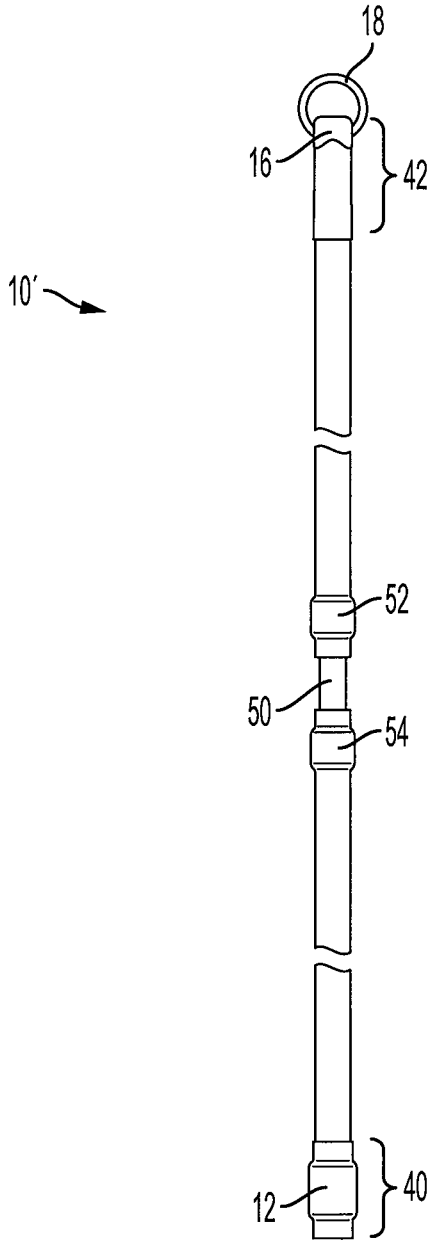
FIG. 10 is a plan view of one of the elastomer tubing devices shown in FIG. 9.
Figure 11:
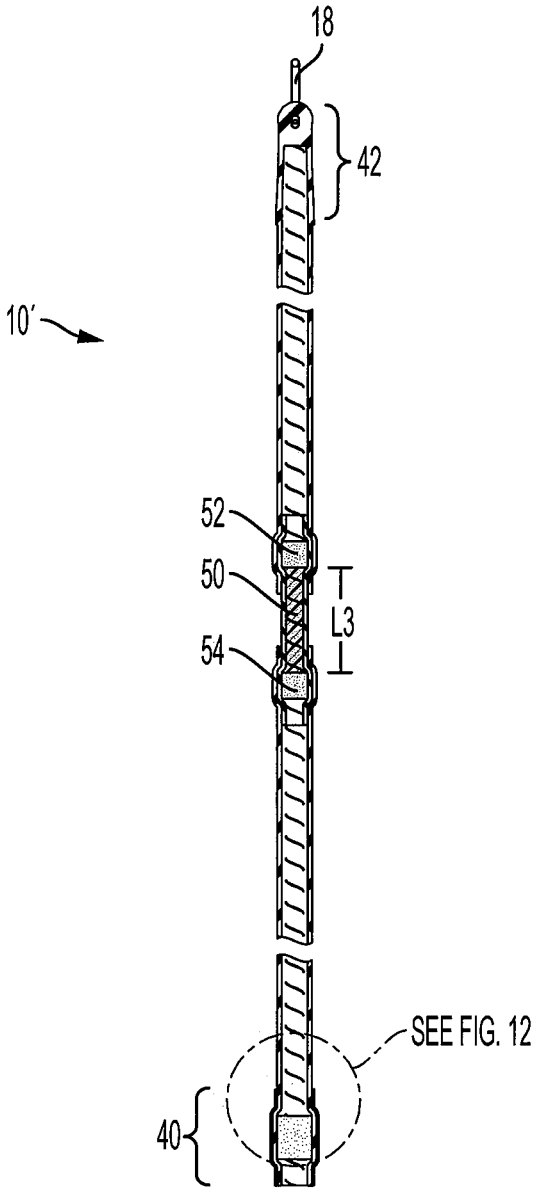
FIG. 11 is a cross-sectional view of the elastomer tubing device of FIG. 10.
Figure 12:
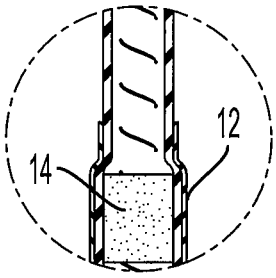
FIG. 12 is an isolated, cross-sectional view of the grip end of the elastomer tubing device of FIGS. 10 and 11.
Figure 13:
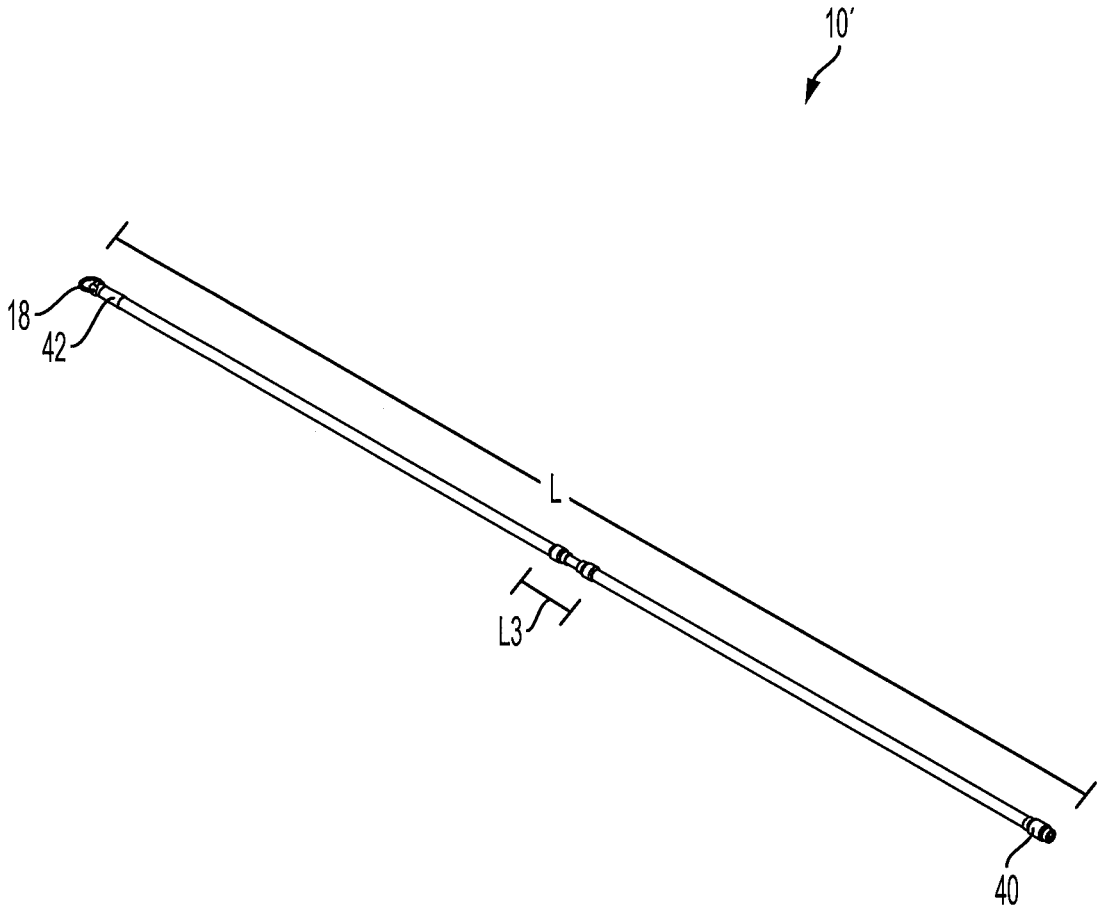
FIG. 13 is a perspective view of the elastomer tubing device of FIG. 10.

Referring now to FIGS. 9-13, in one or more embodiments, the elastomer tubes of the present invention may be "center loaded" for a portion L3 of the resting length L of the tube 10' in order to change the resistance profile. As best shown in FIGS. 10 and 11, the weighted center 50 of the tube may be bookended by plugs 52, 54 on either side of the weight portion 50 to concentrate the increased weight over a defined area. In one embodiment, sand may comprise the weighted portion; however, it should be understood by those skilled in the art that in other embodiments, other sources of additional mass may also be used. Increasing the mass at the midpoint of the tube 10' helps with acceleration and coil/recoil of the tubes during current velocity. The mass characterizes the change in resistance profile, which functions while being under the disruption of inertia or while in use by the end user during manual oscillation patterns. It has been shown that a center loaded area positioned an approximate midpoint of the tube and comprising about 2% to about 7% of the resting length L of the tube 10' is most effective. For a 9 ft. 5 in. tube, the weighted portion may comprise about 2% of the resting length L of the tube, and for a shorter tube, such as an 8 ft. tube, the weighted portion may comprise about 7% of the resting length L of the tube.

A pair of strings or cords (not shown, for clarity) may extend within and along the length of the tube to provide additional safety features, as described above. One cord may be attached to the metal ring 18 at one end of the tube and extend to the first plug bookending the center load, and a second cord may extend from the opposite plug bookending the center load to the end cap or hand grip at the opposing end of the tube.

In another embodiment of the present invention, each end of the tube includes a hand grip for opposing users to engage in the performance of HIIT exercises involving two participants. Rather than anchoring one end of the tube to a fixed point via an attachment means such as an O-ring or D-ring, this embodiment includes a safety strap extending from each end of the tube to a hand grip or guard. The safety strap may be an imperial parachute cord, approximately ⅛" in diameter and having a tensile strength of about 425 lbs. The cord may extend approximately 13 inches from an end cap plug disposed within each end of the tube, increasing the overall length of the device (at rest) and safety strap by about 26". It should be understood by those skilled in the art that the safety strap measurements discussed have been shown to be effective in actual use but are being described for exemplary purposes only, as dimensions other than ⅛" in diameter and 13" in length are not precluded. At the end of the cord is a hand grip or rubber guard, which may be about 4" in length, for grasping by the end user. An adjustable locking mechanism, such as a bowling pin cord lock, may be positioned between the hand grip and the end cap plug. Once the end user has the safety strap in place, it is recommended to adjust the cord lock to shorten the distance between the hand grip and the cord lock, thus ensuring a non-slip strap as a safety measure.

In contrast to the embodiments described above, this embodiment of the present invention is a two-person device that does not need to be anchored to a fixed point and thus may be used virtually anywhere and at anytime. Use of the device simultaneously increases cardio respiratory endurance, strength, and cognitive motor skill demand on the entire body, focusing on training the brain muscle connection optimally, while providing the integration needed for athletic skill sets. Kinesthetic and visual training is enhanced in all planes of motion, and coordination and balance trigger a reestablished connection between the brain and body, including: improving cognitive skills, increasing reaction speed and timing; boosting attention span and memory function; improving motor skills; and improving hand-eye coordination.

The position of the end user (athletic ready position) will enhance its benefits. The position (athletic posture—similar to getting ready to return a serve in tennis) gives the user a better foundation, and or platform to which force is exerted.

Once a user initiates the shaking/oscillating of the tubes of the present invention, it engages deep stabilizing (local) muscles, works on deep core abdominal muscles, and activates outer muscles responsible for coordination and strength. A fitness method combines bouts of cardio-vascular-like movement patterns that strengthen the entire musculoskeletal system. Exercises conducted with the tubes of the present invention, which in use (i.e. in oscillation) mimic a spring-like fluid movement, are designed to elevate the heart rate, and work the muscles of the entire body.

In accordance with one significant oscillation exercise, the participant, while preferably in a stable environment, draws in the muscles of the transverse abdomen and holds the muscular state throughout the entire short bout from one to three minutes. It is preferable that the spine be in as close to neutral posture as possible during the exercise, otherwise such abnormality in posture can cause failure to achieve desired results or the user will deviate from the intended goals of the exercise.

Particularly with user-controlled exercises, such as those of the present invention, it is essential that the abdominal muscles be drawn in toward the spine, distinct from simply "sucking in" the stomach. The user-controlled exercises described below are exemplary methods of using the exercise device of the present invention, and it should be understood by those skilled in the art that the present invention is not limited to such exercises and that other such exercises are contemplated within the scope of the present invention.

Exemplary methods of using the elastomer exercise apparatus of the present invention in a High Intensity Interval Training ("HIIT") exercise routine are described in detail below. However, it should be understood by those skilled in the art that the elastomer properties and anchoring system of the tubing of the present invention allow the tubing to be used in limitless movements over horizontal, sagittal and/or angled vertical planes, such that a virtually unlimited number of exercises can be developed utilizing the tubing of the present invention, depending on a desired intensity level. Each exercise described below is presented by its level of intensity, the lowest intensity being first to the highest intensity being last.

Figure 14A:
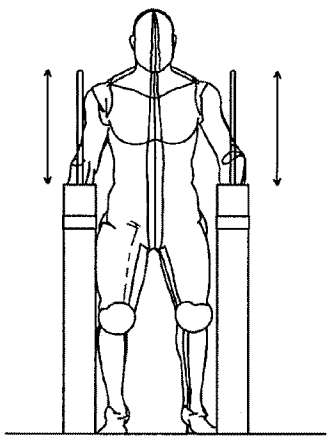
FIGS. 14A to 14C are front, side, and perspective views, respectively, of a first embodiment of a HIIT exercise utilizing the elastomer exercise apparatus of the present invention anchored to a fixed mount.
Figure 14B:
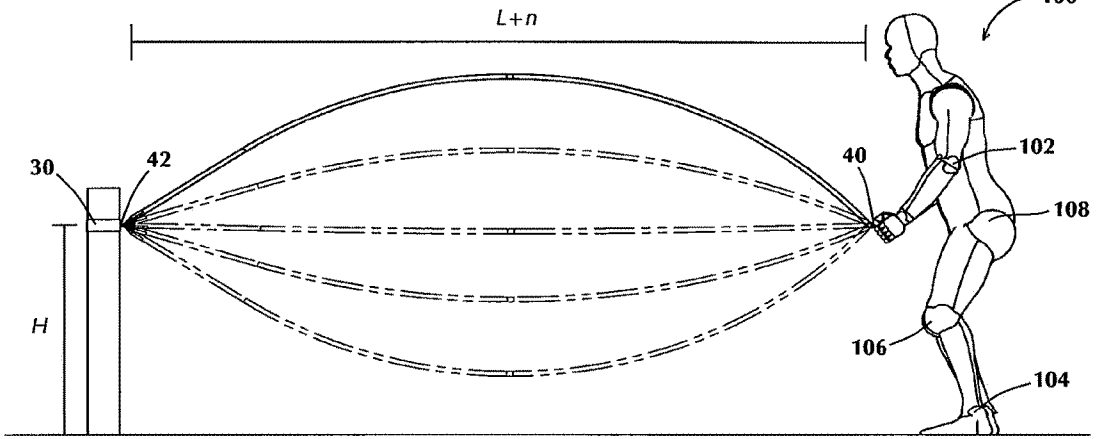
Figure 14C:
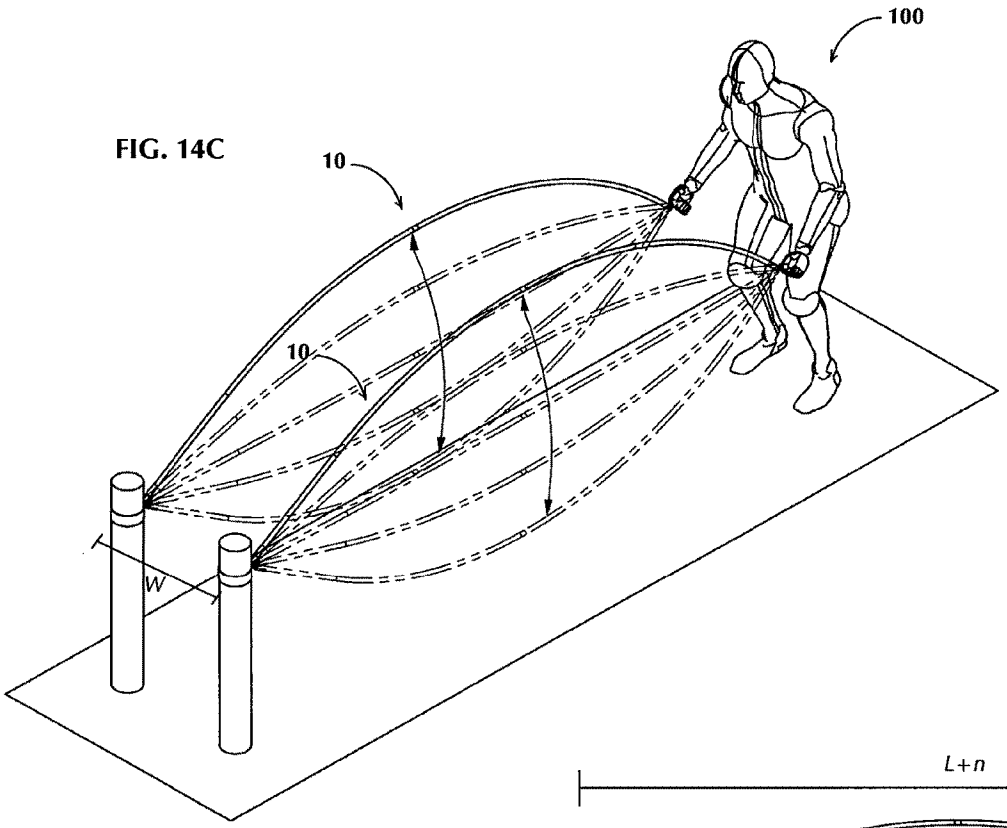

Inertia Wave™—As shown in FIGS. 14A-14C, in this and all other embodiments of the exercises described herein, the tubes are anchored to fixed anchor points 30 opposite the user 100 at a height H of between about 36 inches to about 45 inches above ground level, and at a distance W of between about 24 inches and about 36 inches apart between the anchored ends 42 of the tubes. The tubes 10 have been stretched a predetermined distance L+n beyond their resting length L. The user's body 100 is kept spring-like and stiff at the same time. Elbows 102 are driven back away from the fixed anchor point 30 of the tubes 10. The body 100 has a flexed ankle 104, knee 106, and hip 108 employed during the Inertia Wave method, such that the body is in a partially crouched or seated position. As further shown in FIGS. 14A-14C, the user 100 holds the grip end 40 of each tube 10 securely in each hand and starts to gently spring the length of both tubes simultaneously up and down, as if the user were shaking water off their hands. The tubes 10 should not touch the ground during motion. The method of Inertia Wave is an oscillating, spring-like up and down continuous pattern. The momentum of the tube acts like a coil/recoil from the center of the tube as it springs up and down.

Figure 15A:
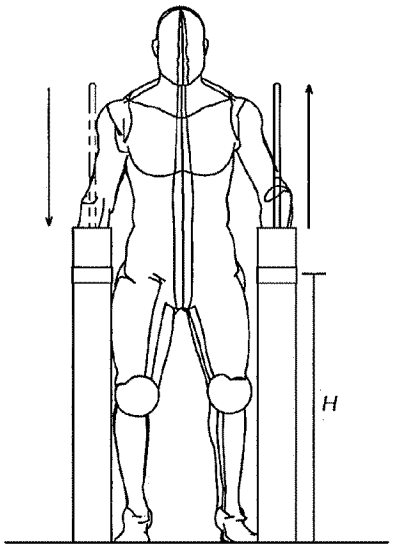
FIGS. 15A and 15B are front and perspective views, respectively, of a second embodiment of a HIIT exercise utilizing the elastomer exercise apparatus of the present invention anchored to a fixed mount.
Figure 15B:
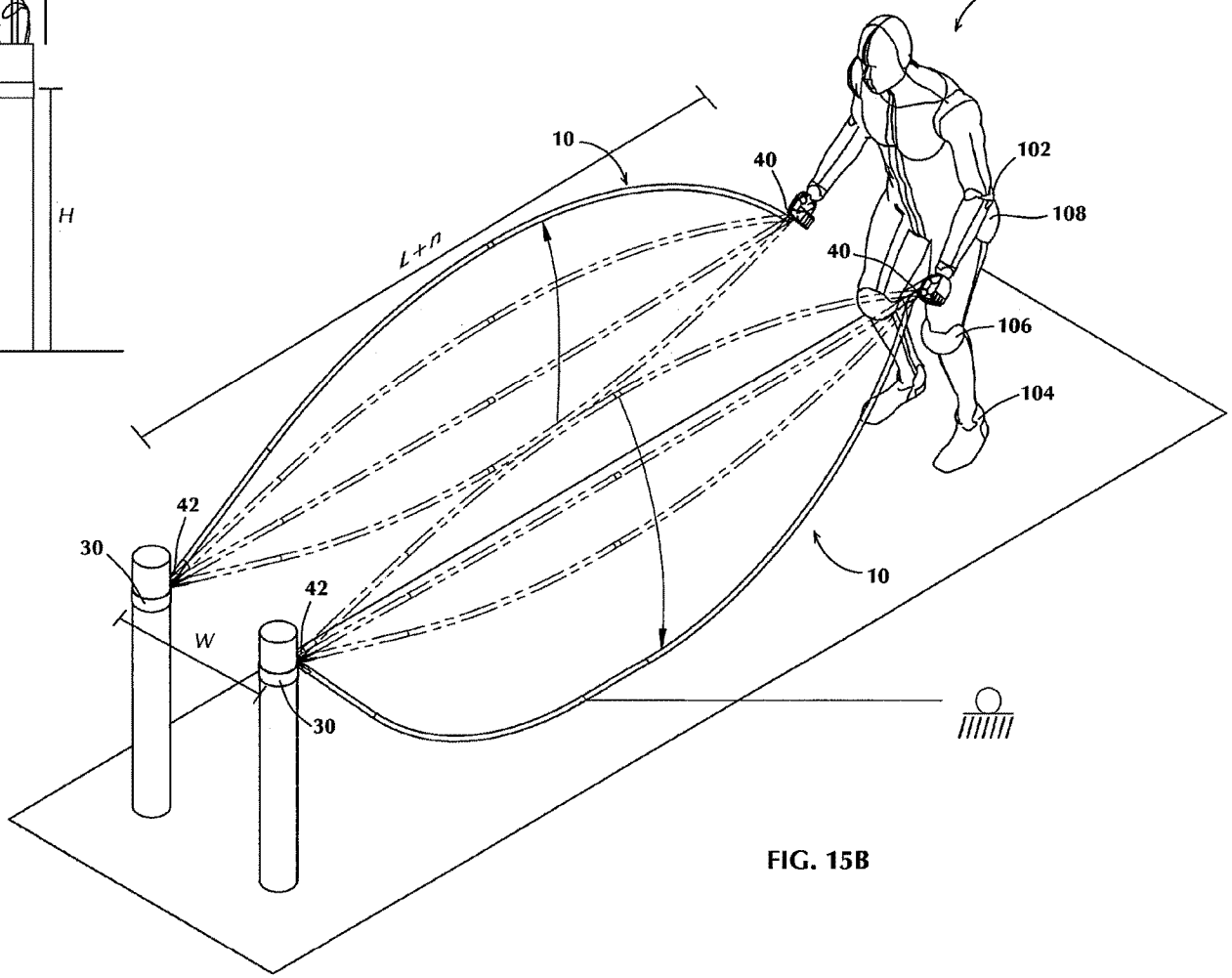

Hero Wave™—As shown in FIGS. 15A and 15B, the tubes are anchored to fixed anchor points 30 opposite the user 100 at a height H above ground level, and at a distance W between the anchored ends 42 of the tubes. The tubes 10 have been stretched a predetermined distance L+n beyond their resting length L. Keep the body 100 spring-like and stiff at the same time. Elbows 102 are driven back away from the fixed anchor point 30 of the tubes. The body has a flexed ankle 104, knee 106, and hip 108 employed during the Hero Wave method. As further shown in FIGS. 15A and 15B, the user 100 holds the grip end 40 of each tube 10 securely and starts to spring the tubes 10 as if to recreate the motion of a "drum roll." The center of the tubes will hit the ground upon proper performance. The method of Hero Wave is a spring like oscillating continuous drum roll pattern with each tube moving alternately in opposite directions throughout. The momentum of the tube acts like a coil/recoil from the center of the tube as it springs up and down.

Figure 16A:
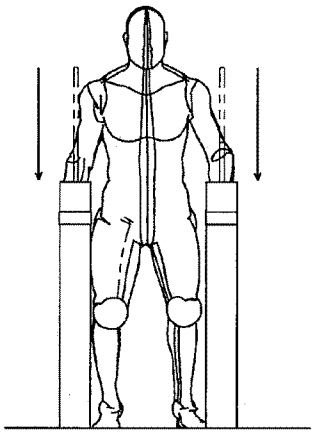
FIGS. 16A to 16C are front, side, and perspective views, respectively, of a third embodiment of a HIIT exercise utilizing the elastomer exercise apparatus of the present invention anchored to a fixed mount.
Figure 16B:
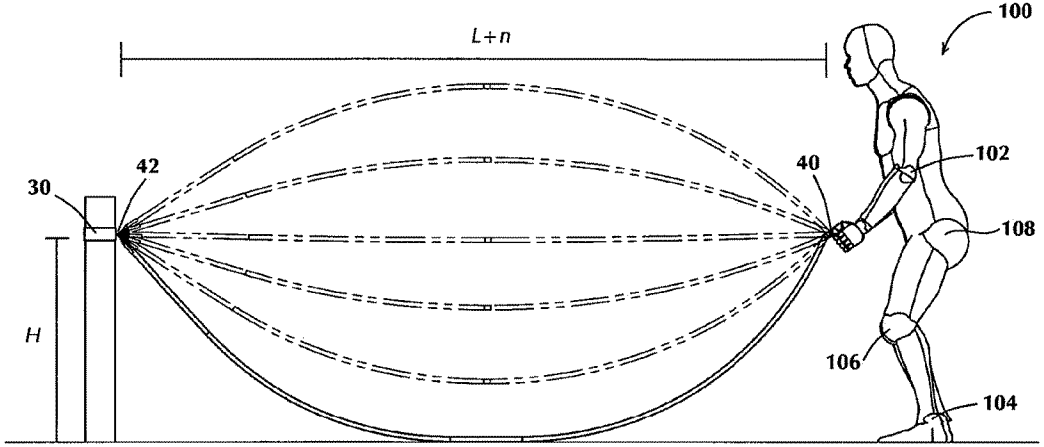
Figure 16C:
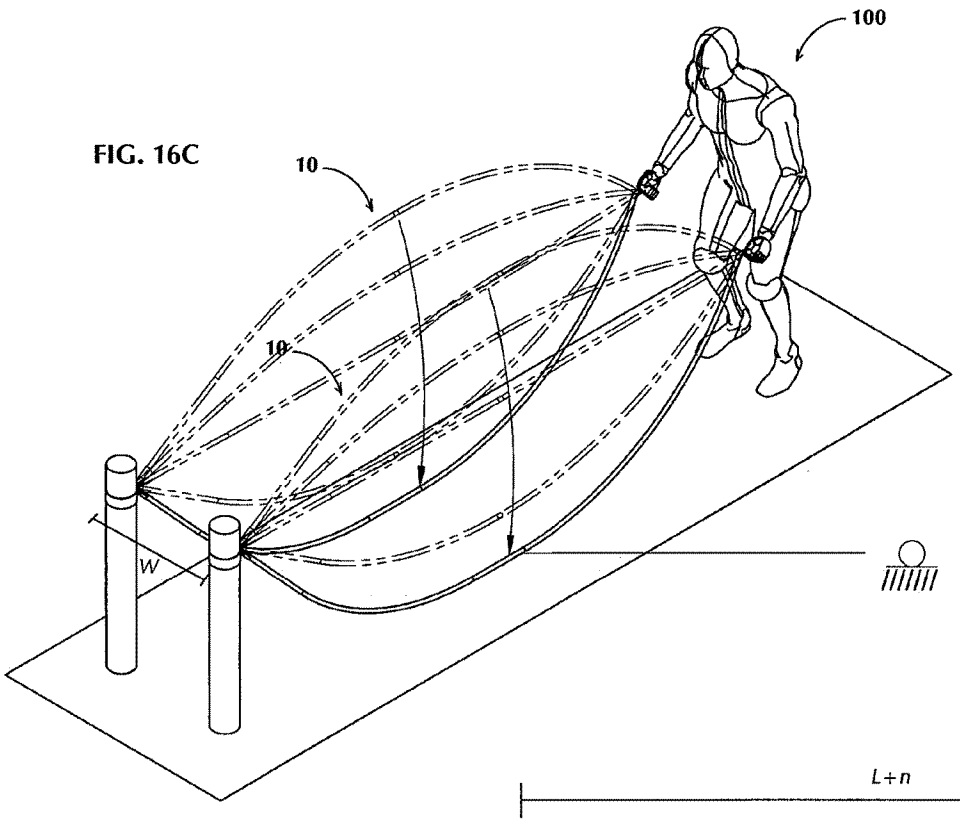

Thunder Slap™—As shown in FIGS. 16A to 16C, the tubes are anchored to fixed anchor points 30 opposite the user 100 at a height H above ground level, and at a distance W between the anchored ends 42 of the tubes. The tubes 10 have been stretched a predetermined distance L+n beyond their resting length L. Keep the body 100 spring-like and stiff at the same time. Elbows 102 are driven back away from the fixed anchor point 30 of the tubes 10. The body has a flexed ankle 104, knee 106, and hip 108 employed during the Thunder Slap method. As further shown in FIGS. 16A to 16C, the user 100 holds the grip end 40 of each tube 10 securely and starts to gently spring the length of both tubes simultaneously as if they were shaking water off their hands. The method of Thunder Slap is a spring-like oscillating up and down continuous pattern. Both tubes 10 are raised with the oscillated spring-like force. As the speed builds from the user's oscillating motions, the tubes are slapped together on the ground. The momentum of the tube acts like a coil/recoil from the center of the tube as it springs up and down and it slaps the floor. Keep the slap, keep the momentum.

Figures 17A, 17B:
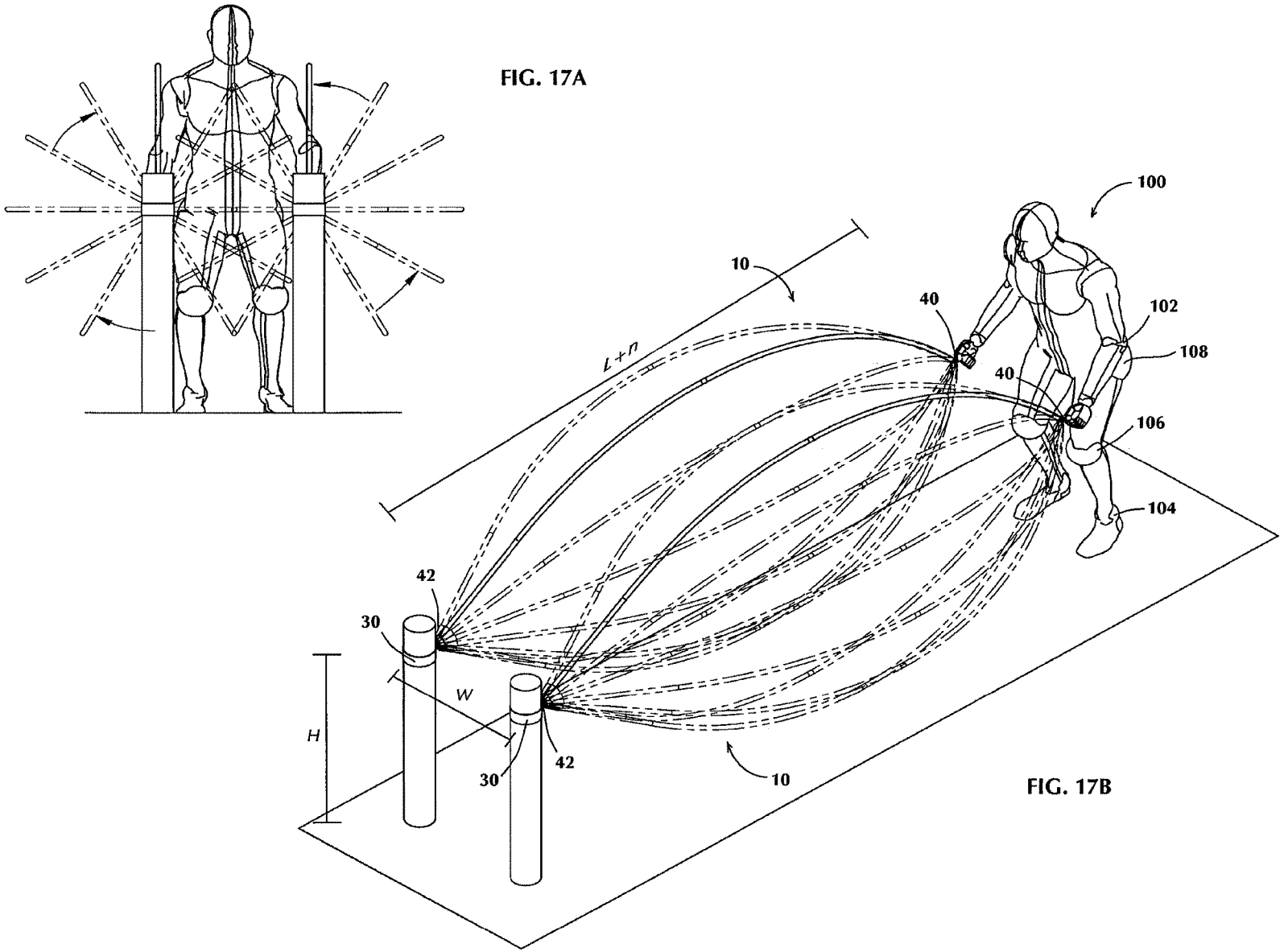
FIGS. 17A and 17B are front and perspective views, respectively, of a fourth embodiment of a HIIT exercise utilizing the elastomer exercise apparatus of the present invention anchored to a fixed mount.

Double Over™—As shown in FIGS. 17A and 17B, the tubes are anchored to fixed anchor points 30 opposite the user 100 at a height H above ground level, and at a distance W between the anchored ends 42 of the tubes. The tubes 10 have been stretched a predetermined distance L+n beyond their resting length L. Keep the body 100 spring-like and stiff at the same time. The body has a flexed ankle 104, knee 106, and hip 108 employed during the Double Over method. Elbows 102 are driven back away from the fixed anchor point 30 of the tubes 10. As further shown in FIGS. 17A and 17B, the user 100 holds the grip end 40 of each tube 10 securely, keeping wrists strong, and starts to internally rotate the tubes in opposite clockwise and counterclockwise directions to gently spring the length of both tubes at offset times as if they were performing the common jump rope technique of "double dutch." The motion creates a circumduction pattern as one tube passes over the other. The method of Double Over is a spring-like oscillated up and down continuous pattern. The momentum of the tube acts like a coil/recoil from the center of the tube as it springs up and down.

Figure 18C:
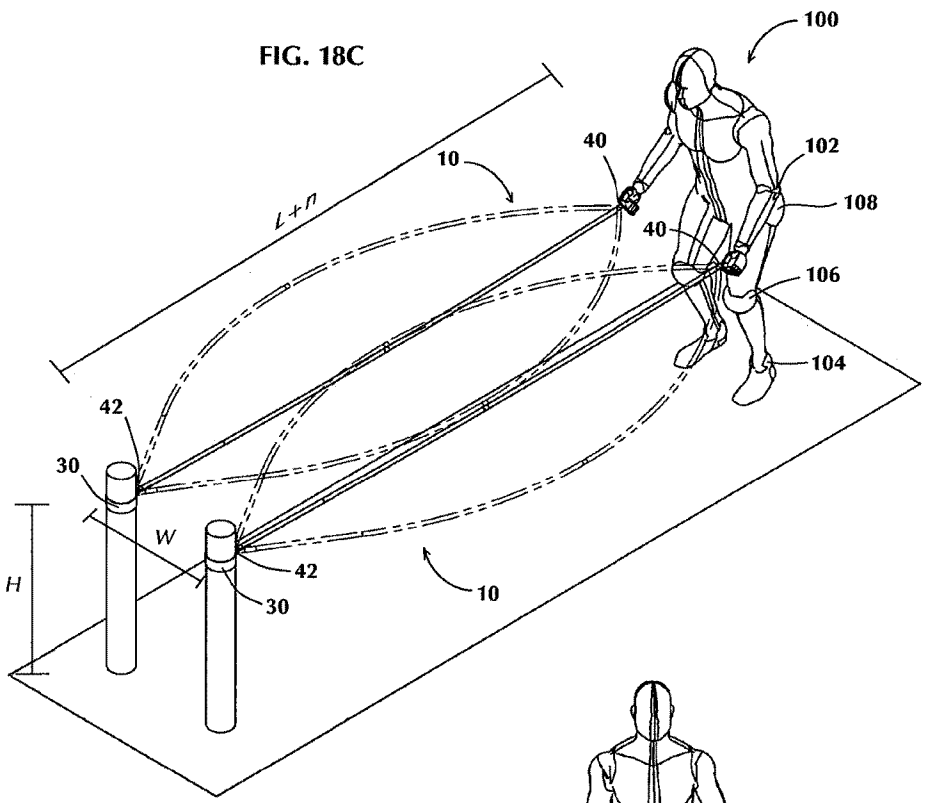
FIGS. 18A to 18C are top down, front, and perspective views, respectively, of a fifth embodiment of a HIIT exercise utilizing the elastomer exercise apparatus of the present invention anchored to a fixed mount.
Figure 18B:
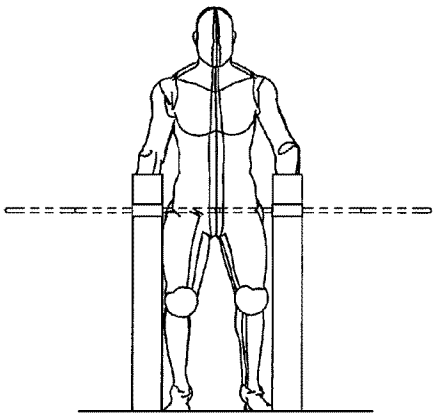
Figure 18A:
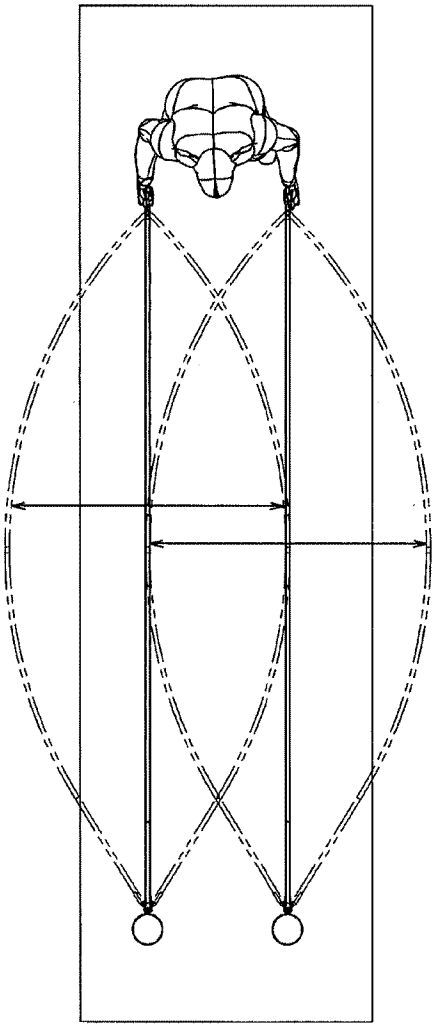

Cross Fire™—As shown in FIGS. 18A to 18C, the tubes are anchored to fixed anchor points 30 opposite the user 100 at a height H above ground level, and at a distance W between the anchored ends 42 of the tubes. The tubes 10 have been stretched a predetermined distance L+n beyond their resting length L. Keep the body 100 spring-like and stiff at the same time. The body has a flexed ankle 104, knee 106, and hip 108 employed during the Cross Fire method, with elbows driven back away from the fixed anchor point 30 of the tubes 10. Elbows 102 are driven back away from the fixed anchor point 30 of the tubes 10. As further shown in FIGS. 18A to 18C, the user 100 holds the grip end 40 of the tube 10 securely and starts to transversely flutter both tubes simultaneously on a horizontal plane. Both tubes 10 move together as if to emulate one continuous snake slithering through the grass. The method of Cross Fire is a spring-like oscillating side-to-side continuous pattern. Both tubes 10 are simultaneously rocked on a horizontal plane with the oscillated spring-like force as the speed builds from the user, resulting in the tubes following each other in a whipping motion. The momentum of the tube acts like a coil/recoil from the center of the tube as it springs like a snake on the transverse horizontal plane.

Figure 19A:
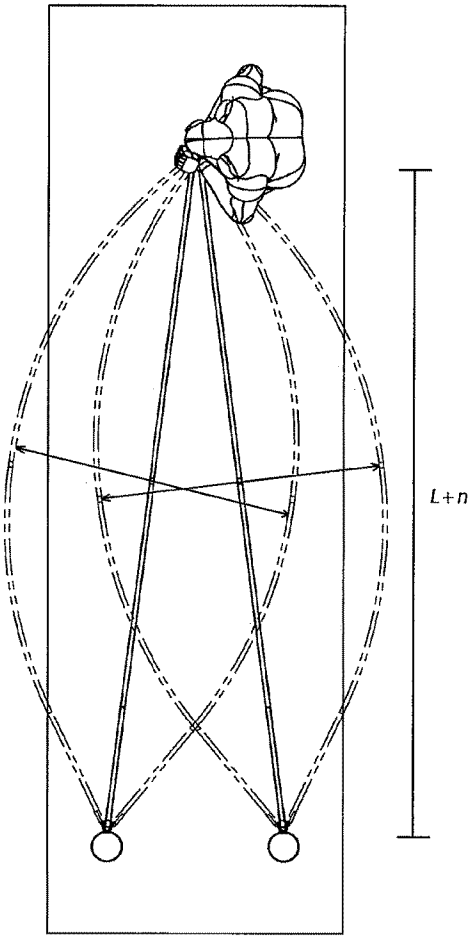
FIGS. 19A to 19C are top down, side, and perspective views, respectively, of a sixth embodiment of a HIIT exercise utilizing the elastomer exercise apparatus of the present invention anchored to a fixed mount.
Figure 19C:
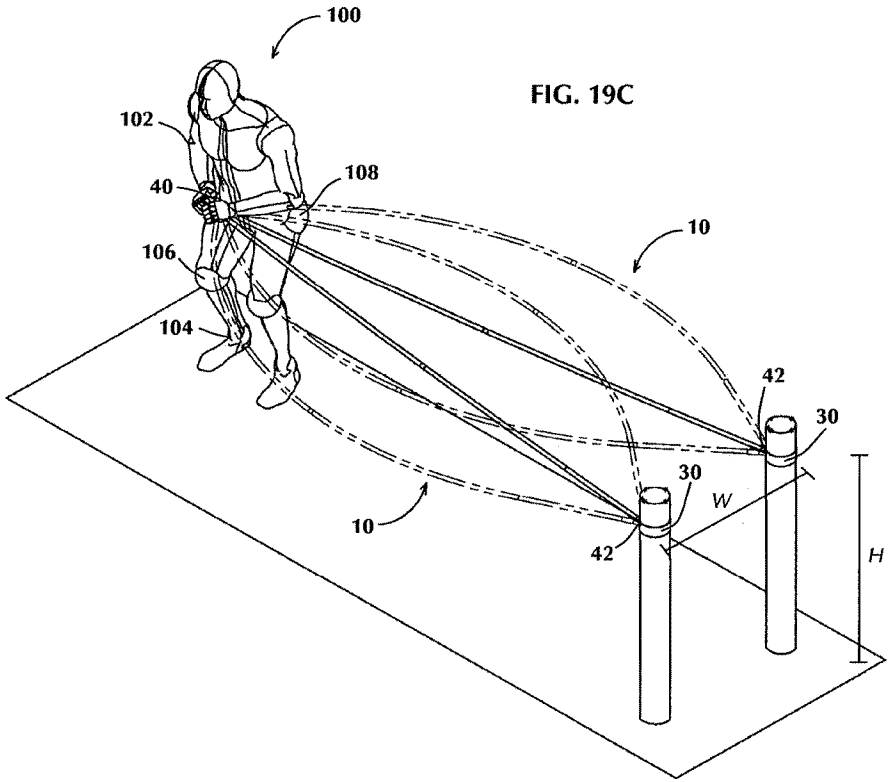
Figure 19B:
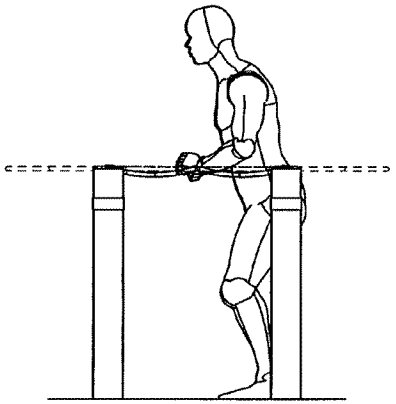

Super Typhoon™—As shown in FIGS. 19A to 19C, the tubes are anchored to fixed anchor points 30 opposite the user 100 at a height H above ground level, and at a distance W between the anchored ends 42 of the tubes. The tubes 10 have been stretched a predetermined distance L+n beyond their resting length L. Keep the body 100 spring-like and stiff at the same time. The body has a flexed ankle 104, knee 106, and hip 108 employed during the Super Typhoon method. Elbows 102 are driven back away from the fixed anchor point 30 of the tubes 10. As further shown in FIGS. 19A-19C, the user 100 stands in line with the tubing or bands (one quarter turn to the right then left). The user stands perpendicular as they center the two tubes 10 in-line with the center of their chest about 4-8 inches out from body. The user holds the grip end 40 of each tube securely and starts to transversely flutter both tubes simultaneously on a horizontal plane, similar to the Cross Fire method described above. Both tubes 10 move cooperatively or in tandem. The method of Super Typhoon is a spring like oscillating side-to-side continuous pattern. Both tubes 10 are simultaneously rocked on a horizontal plane with the user's body 100 turned one quarter rotation, or about 45 degrees. The tubes 10 follow each other in a whipping motion as the speed builds from the user, resulting in an oscillated, spring-like force. The momentum of the tube acts like a coil/recoil from the center of the tube as it springs on the transverse horizontal plane. The user will then switch to the opposing side based on perceived rate of exertion (one half, or 180 degrees turn to the opposite side and continue oscillation).

Figure 20B:
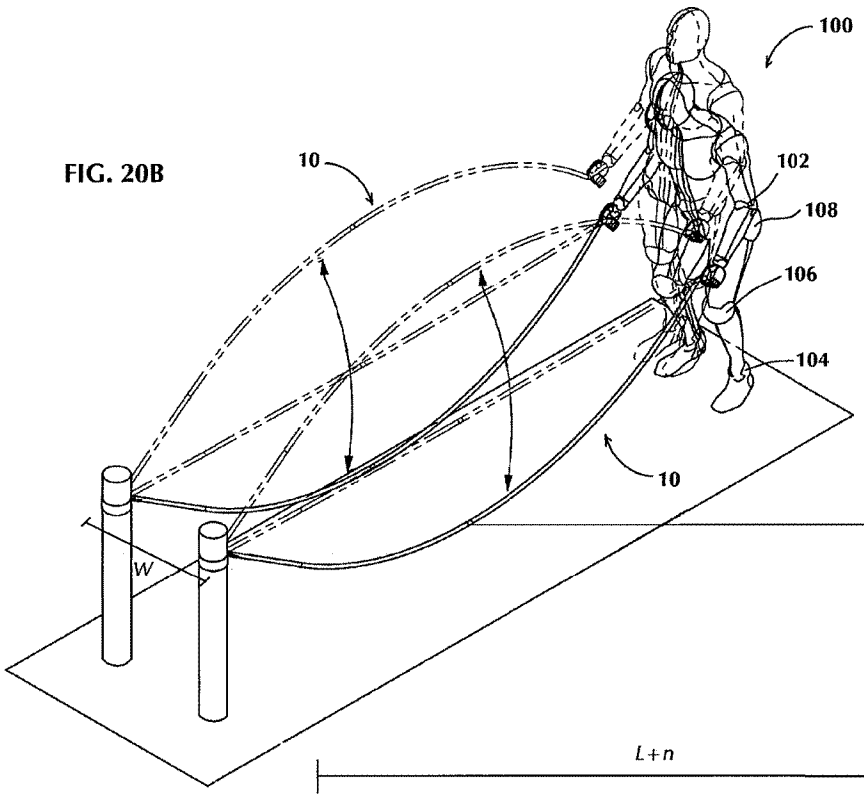
FIGS. 20A and 20B are side and perspective views, respectively, of a seventh embodiment of a HIIT exercise utilizing the elastomer exercise apparatus of the present invention anchored to a fixed mount.
Figure 20A:
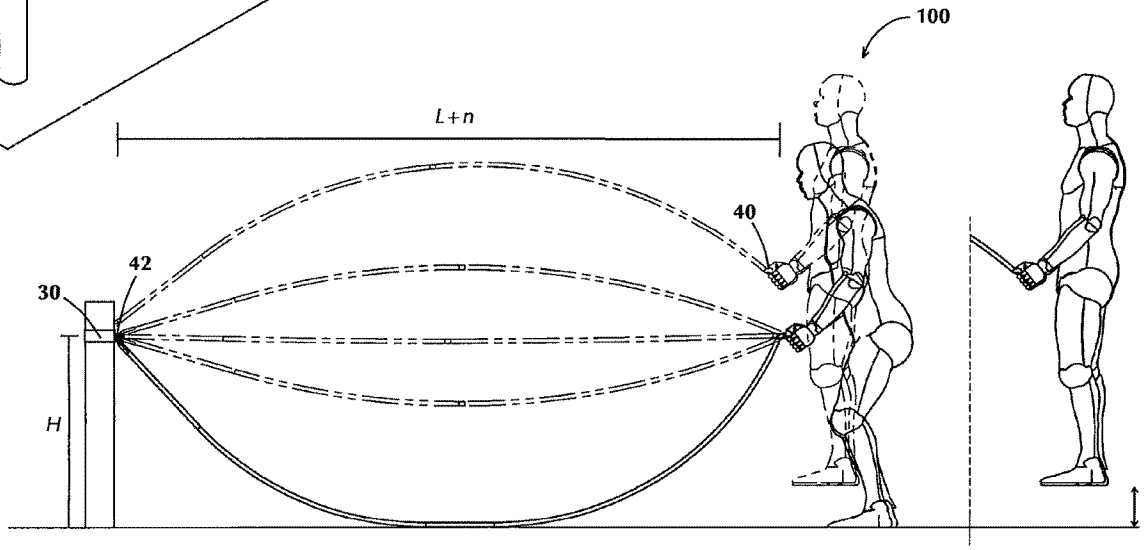

Oxygen Thief™—As shown in FIGS. 20A to 20B, the tubes are anchored to fixed anchor points 30 opposite the user 100 at a height H above ground level, and at a distance W between the anchored ends 42 of the tubes. The tubes 10 have been stretched a predetermined distance L+n beyond their resting length L. Keep the body 100 spring-like and stiff at the same time. The body has a flexed ankle 104, knee 106, and hip 108 employed during the Oxygen Thief method. Elbows 102 are driven back away from the fixed anchor point 30 of the tubes 10. As further shown in FIGS. 20A and 20B, the user 100 holds the grip end 40 of each tube 10 securely and starts to gently spring the length of both tubes simultaneously as if they were shaking water off their hands. The method of Oxygen Thief is a spring-like oscillating up and down continuous pattern. Both tubes 10 are raised with the oscillating spring-like force as the speed builds from the user and the tubes are slapped together on the ground. The momentum of the tube 10 acts like a coil/recoil from the center of the tube as it springs up and down and it slaps the floor. This is a similar pattern to the Thunder Slap method, but further incorporating a jump squat during the slaps. The user 100 continuously slaps the ground as they athletically decelerate/descend to a semi-squat position, then immediately accelerate/rise to "pop" off of the ground several inches. The user 100 should be in the air as the tubes hit the ground, and then—by force of gravity—the user returns to the ground and decelerates safely back to a strong spring-like and stable athletic posture. The user 100 will repeat this method several times. The tubes are slapping the ground as the user is performing mini jump squats.

Each of the above methods of using the present invention in a HIIT exercise routine can be performed using either the anchored or two-person embodiments of the elastomer exercise apparatus. However, additional methods of use can be unlocked using the two-person embodiment. One user may comprise the "Anchor" side, while an opposing user or the "Wave Maker" creates the energy displaced in the tubes as he or she oscillates the tubes. The "Anchor" thus tries to control the oscillations or waves as they enter the body. In other methods, each user can be the "Wave Maker" simultaneously, thus creating additional force profiles.

Hurricane Walk™—The Wave Maker stands strong, stable, and braced. The body is kept spring-like and stiff at the same time. The body has a flexed ankle, knee, and hip employed. The Wave Maker holds the end cap of the tube securely and starts to gently spring the length of both tubes simultaneously as if shaking water off your hands. Both tubes will rise and fall with the oscillated spring-like force. As the Wave Maker continues to perform the Inertia Wave method, the Anchor holding the opposing ends of the tubes stands strong, stable, and in a staggered stance, with arms angled out over the head forming the letter "Y" and facing out and away from the Wave Maker, with his or her back to the Wave Maker. As the Wave Maker continues the Inertia Wave method, the Anchor starts to slowly (under active control—and slightly flexed hip) walk forward as he or she controls posture and awareness of their body & environment. The Wave Maker's challenge is to cognitively "follow" the Anchor to provide the same or appropriate resistance/oscillating profile throughout the Hurricane Walk. The ultimate objective is for the Wave Maker to follow the Anchor, while maintaining the resistance profile in a fluid, consistent manner to achieve optimal engagement of core and stability muscles—including the shoulder complex.

Wavelength™—The Wave Maker stands strong, stable, and braced in an athletic stance, keeping the body spring-like and stiff at the same time. The body has a flexed ankle, knee, and hip employed. The Wave Maker holds the end cap of the tube securely and starts to gently spring the length of both tubes simultaneously as if shaking water off your hands. Both tubes will rise and fall with the oscillated spring-like force. As the Wave Maker continues to perform the Inertia Wave Method, the Anchor stands strong, stable, and in a staggered stance, facing the Wave Maker and holding the tubes with his or her arms extended to form the letter "T", i.e., fully stretched out with palms down at just below shoulder level, on a horizontal plane forming a straight line initially and extending out from the ears. The Anchor then bends his or her arms at the elbow at 90 degrees forming an "L" shape, palms down and shoulder blades retracted (i.e. squeezed back), and continues to hold this position. For safety reasons, please always hold the end caps securely wearing safety straps.

The Wave Maker continues to perform the Inertia Wave method, while the Anchor (under active control and slightly flexed hip) controls posture, while maintaining awareness of their body & environment, as they continue to maintain retracted shoulder blades on a horizontal plane ("on the shelf" with arms staying in the stable, raised position). The Anchor's challenge is to stay in perfect anatomical positioning (strong, stable, retracted shoulder blades drawn back) during the opposing external waves transmitting through the body. The ultimate objective for the Anchor is to maintain congruency or hold the "arms on shelf" position throughout. This rotator complex exercise achieves optimal engagement of shoulder girdle stability muscles—including the entire shoulder region.

Typhoon Challenge™—The Wave Maker and Anchor stand at opposite ends, facing each other initially, as they turn to the right or left. (Elbows close to side-palms down—both hands holding both end caps of tubes). On each other's verbal cue, both participants start to flutter the tubes transversely, such as along a "table top", with both tubes following each other. Hands must be directly in front of chest (not lower than nipple height). Both the Wave Maker and Anchor flutter the tubes simultaneously as they build the momentum, speed, and wind sound of the tubes. This can be performed with 1 or 2 tubes. As a team, the Wave Maker and Anchor verbally cue each other to switch and rotate to the other side.

Shockwave™—This method is for those who want to really challenge their cognitive-awareness, along with communication skills. Both users will flutter the tubes at specific levels. Each level is performed for a 5 second countdown. Envision a clock from 1:00 to 5:00. Starting at 3:00 (i.e., directly in front of the sternum, and no lower), follow this "Flutter Pattern" & Flutter Count: START: 3:00 5,4,3,2, 1 . . . 2:00 5,4,3,2,1 . . . 1:00 5,4,3,2,1 . . . 3:00 5,4,3,2, 1 . . . 2:00 5,4,3,2,1 . . . 3:00 5,4,3,2,1 . . . 4:00 5,4,3,2, 1 . . . 5:00 5,4,3,2,1 . . . 4:00 5,4,3,2,1 . . . 3:00 5,4,3,2,1 and STOP.

The Wave Maker and Anchor stand at opposite ends, facing each other initially, as they ¼ turn to the right or left, with elbows close to sides-palms down-both hands holding both end caps of tubes. On each other's verbal cue, they start to flutter the tubes transversely such as along a "table top", with both tubes following each other. Hands must be directly in front of chest and no lower than the sternum. Both the Wave Maker and Anchor flutter the tubes simultaneously as they build the momentum, speed, and wind sound of the tubes. This can be performed with 1 or 2 tubes. As a team they verbally cue each other to switch and rotate to the other side.

Single Leg Wave™—The Wave Maker stands strong, stable, and braced, keeping the body spring-like and stiff at the same time. The body has a flexed ankle, knee, and hip employed. The Wave Maker holds the end caps of the tubes securely and starts to gently spring the length of both tubes simultaneously as if shaking water off your hands. Both tubes will rise and fall with the oscillated spring-like force. As the Wave Maker continues to perform the Inertia Wave method, the Anchor holds the opposing end caps securely, while driving his or her elbows back and close to their sides. The Anchor slowly hip flexes and starts to raise one knee and foot off the ground until the thigh is parallel to the ground. Hold the position for approximately four seconds, switch legs, and repeat several times.

Thumbs Up™—User's feet should be spaced no further than 12-inches apart with knees spring-like bent. Holding the end caps of the tubes, with thumbs up, keep the body spring-like and stiff at the same time. The body has a flexed ankle, knee, and hip employed. Both the Wave Maker and the Anchor grip/hold with the end cap holes facing up. Elbows held high and no wider than shoulder width apart, with the tubes held securely. The Wave Maker starts to gently spring the length of both tubes simultaneously in rhythm (do not muscle it). The Anchor is in same stance and position as the Wave Maker. The Wave Maker starts the Inertia Wave method, while the Anchor holds his or her ground as the Wave Maker builds speed and energy in the tubes, keeping elbows sternum high and close to body. At the Anchor's choice, verbally cue the Wave Maker to become the Anchor. Keep switching roles until you both cue each other to make waves together.

Kneeling Cross Fire™—The Wave Maker and Anchor are kneeling on a soft surface, pad, or mat, facing each other. Holding both end caps of the tubes securely, with enough tension on the tubes, the Wave Maker has arms stretched out in front of him or her with very slight bend in elbow. Holding both tubes as close as possible together (fists touching-very slight bend in elbows), the Wave Maker starts building the speed, as the Anchor tries to stabilize and hold his or her position. On a verbal cue, change roles. You can also progress by trying to simultaneously perform the Inertia Wave & Cross Fire method (Thumbs-up, Elbows High). While performing the thumbs up Inertia Wave method, knees are almost touching together. Raise the arms until elbows are chin level pointing directly in front of you. Now lean back, as you immediately feel engagement in your abdominals. Now start the Inertia Wave methods, keeping your elbows high, as you build the momentum in the tubes.

Kneeling Anti-Rotation™—The Wave Maker and Anchor are kneeling on a soft surface, pad, or mat, both facing the same wall or direction. Holding both end caps of the tubes securely, with enough tension on the tubes that it slightly tries to rotate/pull you towards each other. The Wave Maker and Anchor have arms stretched out (sternum level—very slight bend in elbow) holding both tubes as close as possible together with both palms down—thumb and first finger touching. The Anchor and Wave Maker start to simultaneously perform the Super Typhoon method, building speed, as they continue the side to side continuous flutter of the tubes. On a verbal cue, slowdown and change to the Super Typhoon method, building the speed under control. The tubes should remain fluttering transversely such as along a "table top," avoiding circular motions.

It should be understood by those skilled in the art that the elastomer properties and anchoring system of the tubing of the present invention allow the tubing to be used in limitless movements over horizontal, sagittal and/or angled vertical planes, such that a virtually unlimited number of exercises can be developed. More particularly, exercise routines utilizing the elastomer exercise apparatus of the present invention can be performed with the user in any of a standing position, a squatting or partially-squatting position, a turned or partially-turned squatting position, a prone position, a supine position, or in a seated or partially-seated position.

Thus, the present invention provides one or more of the following advantages. The elastomer exercise apparatus of the present invention provides an improved exercise device for performing HIIT exercises that has superior impact on muscle control and development, as opposed to more conventional means of HIIT. The elastomer tubing of the present invention further provides a means to achieve the aerobic and anaerobic benefits of HIIT without added stress to one's joints. With relatively small body movements, a user can quickly establish an oscillation, and once in motion, the elasticity and resistance of the elastomer tubing properties helps the user maintain an oscillating wave pattern. Use of the elastomer tubes of the present invention results in predominantly high intensity open capillary beds receiving more liters of oxygen (aerobic) versus heavy battle ropes which close capillary beds, calling upon and engaging the outer superficial musculature. Battle ropes require constant effort to maintain a steady oscillation, whereas a user of the elastomer tubing of the present invention can instead focus on other important aspects of their workout, such as maintaining posture and body movements, increasing the velocity of the bands without allowing it to move in alternate planes of motion, and developing endurance. The independent or tandem oscillation of each tube, in connection with the user working against the inertia of the oscillating waves created, further assists in the development of symmetrical strength and coordination.

While the present invention has been particularly described, in conjunction with specific embodiments, it is evident that many alternatives, modifications and variations will be apparent to those skilled in the art in light of the foregoing description. It is therefore contemplated that when understood by one of ordinary skill in the art, the present invention will embrace any such alternatives, modifications and variations as falling within the true scope and spirit of the present invention.

Thus, having described the invention, what is claimed is:

1. An exercise apparatus, comprising:

a pair of elastomer tubing devices, each elastomer tubing device having a resting length, a resting inner diameter, a resting outer diameter, and a tube thickness, each elastomer tubing device being stretchable beyond the resting length and further having a first end comprising a segment having a second outer diameter greater than said resting outer diameter and forming a hand grip for a user, and an opposing end including an anchor portion to enable said opposing end to be releasably attached to a fixed mount, at least one of the elastomer tubing devices comprising a Q Factor of about 5, wherein said pair of elastomer tubing devices are independently affixable to one or more fixed mounts at a first distance between said respective anchor portions along a transverse plane and a second distance above a ground level to permit independent or tandem oscillation of said pair of elastomer tubing devices by the user, said pair of elastomer tubing devices being stretched a predetermined distance beyond the respective resting lengths and maintained at said predetermined distance during said independent or tandem oscillation, a mechanical impedence of said pair of elastomer tubing devices being adjustable by the user working against inertia generated during said independent or tandem oscillation.

2. The exercise apparatus of claim 1 wherein at least one of the elastomer tubing devices has the resting length of about 9 ft 5 inches, the resting inner diameter of about ½ inch, the resting outer diameter of about ¾ inch, and the tube thickness of about ⅛ inch.

3. The exercise apparatus of claim 1 wherein at least one of the elastomer tubing devices comprises one or more of a tensile strength of about 3500 psi, an elongation of about 750%, a hardness of about 35+/−5 Shore A, a 100% Modulus of 125 psi, and a specific gravity of 0.97.

4. The exercise apparatus of claim 1 wherein said anchor portion comprises a loop end and a metal ring, said loop end folded onto itself and inserted into an opening in said opposing end to secure the metal ring, said loop end held in said opposing end opening by compression.

5. The exercise apparatus of claim 1 wherein at least one of the elastomer tubing devices comprises a center-loaded portion within said resting inner diameter disposed between said first end and said opposing ends and having a mass.

6. The exercise apparatus of claim 5 wherein said center loaded portion comprises between about 2% to about 7% of the resting length of the at least one elastomer tubing device.

7. The exercise apparatus of claim 5 wherein said center loaded portion is bookended by plugs within said resting inner diameter on either side of the center loaded portion to concentrate the mass over a defined area.

8. The exercise apparatus of claim 1 wherein said first distance is between about 24 inches to about 36 inches, and said second distance is between about 36 inches and about 45 inches.

9. The exercise apparatus of claim 1 wherein each elastomer tubing device includes a grip plug disposed within the first end segment for forming the hand grip for the user.

10. An exercise apparatus, comprising:

a pair of elastomer tubing devices, each elastomer tubing device having a resting length, a resting inner diameter, a resting outer diameter, and a tube thickness, each elastomer tubing device stretchable beyond the resting length and further having a first end comprising a segment having a second outer diameter greater than said resting outer diameter for forming a hand grip for a user, and an opposing end including an anchor portion to enable said opposing end to be releasably attached to a fixed mount, at least one of the pair of elastomer tubing devices comprising a center-loaded portion within said resting inner diameter disposed between said first end and said opposing end and having a mass, said center-loaded portion comprising between about 2% to about 7% of the resting length of the at least one elastomer tubing device, wherein said pair of elastomer tubing devices are independently affixable to one or more fixed mounts at a first distance between said respective anchor portions along a transverse plane and a second distance above a ground level to permit independent or tandem oscillation of said pair of elastomer tubing devices by the user, said pair of elastomer tubing devices being stretched a predetermined distance beyond the respective resting lengths and maintained at said predetermined distance during said independent or tandem oscillation, a mechanical impedance of said pair of elastomer tubing devices being adjustable by the user working against inertia generated during said independent or tandem oscillation.

11. The exercise apparatus of claim 10 wherein said center-loaded portion is bookended by plugs within said resting inner diameter on either side of the center-loaded portion to concentrate the mass over a defined area.

12. The exercise apparatus of claim 10 wherein at least one of the elastomer tubing devices has the resting length of about 9 ft 5 inches, the resting inner diameter of about ½ inch, the resting outer diameter of about ¾ inch, and the tube thickness of about ⅛ inch.

13. The exercise apparatus of claim 10 wherein at least one of the elastomer tubing devices comprises one or more of a tensile strength of about 3500 psi, an elongation of about 750%, a hardness of about 35+/−5 Shore A, a 100% Modulus of 125 psi, and a specific gravity of 0.97.

14. The exercise apparatus of claim 10 wherein at least one of the elastomer tubing devices comprises a Q Factor of about 5.

15. The exercise apparatus of claim 10 wherein said first distance is between about 24 inches to about 36 inches, and said second distance is between about 36 inches and about 45 inches.

16. The exercise apparatus of claim 10 wherein said anchor portion comprises a loop end and a metal ring, said loop end folded onto itself and inserted into an opening in said opposing end to secure the metal ring, said loop end held in said opposing end opening by compression.

17. The exercise apparatus of claim 10 wherein each elastomer tubing device includes a grip plug disposed within the first end segment for forming the hand grip for the user.

18. A method of performing an exercise program, said method comprising:

providing a pair of elastomer tubing devices, each elastomer tubing device having a resting length, a resting inner diameter, a resting outer diameter, and a tube thickness, each elastomer tubing device stretchable beyond the resting length and further having a first end comprising a segment having a second outer diameter greater than said resting outer diameter and forming a hand grip for a user, and an opposing end including an anchor portion to enable said opposing end to be releasably attached to a fixed mount, at least one of the elastomer tubing devices comprising a Q Factor of about 5;

independently affixing said pair of elastomer tubing devices to one or more fixed mounts at a first distance between said respective anchor portions along a transverse plane and a second distance above a ground level;

stretching said pair of elastomer tubing devices to a predetermined distance beyond the resting length;

while maintaining said pair of elastomer tubing devices at the predetermined distance beyond the resting length, oscillating said pair of elastomer tubing devices by the user; and adjusting a mechanical impedance of said pair of elastomer tubing devices by the user working against inertia generated during said oscillating.

19. The method of claim 18 wherein said exercise program comprises one or more routines selected from the group comprising: routines performed with the user in a standing position, routines performed with the user in a squatting or partially-squatting position, routines performed with the user in a turned or partially-turned squatting position, routines performed with the user in a prone position, routines performed with the user in a supine position, and routines performed with the user in a seated or partially-seated position.

* * * * *